US008885866B2

(12) United States Patent
Sakaguchi et al.

(10) Patent No.: US 8,885,866 B2
(45) Date of Patent: Nov. 11, 2014

(54) EARPHONE

(75) Inventors: Atsushi Sakaguchi, Osaka (JP); Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 15 days.

(21) Appl. No.: 13/818,185

(22) PCT Filed: Jun. 15, 2012

(86) PCT No.: PCT/JP2012/003934

§ 371 (c)(1),
(2), (4) Date: Feb. 21, 2013

(87) PCT Pub. No.: WO2013/014852

PCT Pub. Date: Jan. 31, 2013

(65) Prior Publication Data

US 2013/0148830 A1 Jun. 13, 2013

(30) Foreign Application Priority Data

Jul. 22, 2011 (JP) ..... 2011-160578
Feb. 29, 2012 (JP) ..... 2012-043931

(51) Int. Cl.
*H04R 25/00* (2006.01)
*H04R 1/28* (2006.01)
*H04R 1/10* (2006.01)

(52) U.S. Cl.
CPC ..... *H04R 1/1058* (2013.01); *H04R 2460/11* (2013.01); *H04R 1/1016* (2013.01); *H04R 2460/15* (2013.01); *H04R 1/2869* (2013.01); *H04R 25/554* (2013.01); *H04R 25/456* (2013.01)
USPC ..... 381/382; 381/380

(58) Field of Classification Search
CPC . H04R 1/1016; H04R 2460/11; H04R 25/652
USPC ..... 381/324, 325, 328, 380, 382, 374; 181/135, 130
See application file for complete search history.

(56) References Cited

U.S. PATENT DOCUMENTS

| | | | | |
|---|---|---|---|---|
| 4,375,016 | A * | 2/1983 | Harada | 181/135 |
| 6,724,902 | B1 * | 4/2004 | Shennib et al. | 381/328 |
| 2010/0061580 | A1 * | 3/2010 | Tiscareno et al. | 381/380 |
| 2010/0166245 | A1 | 7/2010 | Takigawa et al. | |
| 2012/0076341 | A1 | 3/2012 | Ozawa | |

FOREIGN PATENT DOCUMENTS

| | | |
|---|---|---|
| JP | 08-037697 | 2/1996 |
| JP | 08-172691 | 7/1996 |

(Continued)

OTHER PUBLICATIONS

International Search Report issued Sep. 18, 2012 in International (PCT) Application No. PCT/JP2012/003934.

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

Included are a loudspeaker unit for generating sound waves, a sound conduit tube connected to the loudspeaker unit, and an ear tip connected to the sound conduit tube and having a shape having at least one opening. The sound conduit tube has a shape having: a sound hole having a first opening through which the sound waves generated by the loudspeaker unit enter, and a second opening from which the sound waves are released and to which the ear tip is connected; and a vent hole formed independently of the sound hole, and having a third opening through which a portion of the sound waves released from the second opening enters and a fourth opening from which the portion of the sound waves is released. The second opening of the sound hole and the third opening of the vent hole are connected to an identical opening of the ear tip.

20 Claims, 17 Drawing Sheets

(56) References Cited

FOREIGN PATENT DOCUMENTS

| | | |
|---|---|---|
| JP | 11-275692 | 10/1999 |
| JP | 2007-201887 | 8/2007 |
| JP | 2008-532445 | 8/2008 |
| JP | 2010-157814 | 7/2010 |
| WO | 2006/094502 | 9/2006 |
| WO | 2007/086360 | 8/2007 |
| WO | 2010/134313 | 11/2010 |

* cited by examiner

EARPHONE

TECHNICAL FIELD

The present disclosure relates to a vent hole structure of an external auditory canal insertion type earphone.

BACKGROUND ART

With regard to an external auditory canal insertion type earphone used by inserting a receiver into an external auditory canal, a sealed type and an open type exist. The sealed type causes the external auditory canal to be in a sealed state by an ear tip mounted on the tip of the receiver. The open type creates an open state (non-sealed state) as a result of having a connection between outside space and the external auditory canal by a vent hole formed on the ear tip.

For example, Patent Literature 1 proposes a conventional open type earphone having a vent hole formed on an ear tip. FIG. 16 shows a conventional earphone 200 disclosed in Patent Literature 1. In FIG. 16, (a) is a plan view of the earphone 200, and (b) is a cross sectional view along line A-O-B in the earphone 200 shown in (a). Sound waves generated by a loudspeaker unit 201 are released in an external auditory canal via a sound hole 204 formed on a sound conduit tube 202. The sound waves released in the external auditory canal are separated into sound waves that propagate to the eardrum and sound waves that leak to outside space from vent holes 205 formed on an ear tip 203.

CITATION LIST

PATENT LITERATURE

[PTL 1] Japanese Laid-Open Patent Publication No. 2008-532445 (translation of PCT application)

[PTL 2] Japanese Laid-Open Patent Publication No. 2010-157814

SUMMARY OF THE INVENTION

Problems to be Solved by the Invention

The ear tip 203 is formed from a material that deforms so as to fit in the external auditory canal. Therefore, with an open type earphone, the opening size of the vent holes 205 changes depending on the state of the ear tip 203 inserted in the external auditory canal, resulting in a change in output characteristics of the earphone. For example, FIG. 17 shows an experimental example indicating that the sound-pressure/frequency characteristic of an earphone will change depending on the state of the earphone inserted in the external auditory canal even when the same open type earphone is used.

Therefore, the present disclosure will set forth an earphone that can avoid changes to the sound-pressure/frequency characteristic of the earphone.

Solution to the Problems

An earphone of the present disclosure includes: a loudspeaker unit configured to generate sound waves; a sound conduit tube connected to the loudspeaker unit; and an ear tip connected to the sound conduit tube, and having a shape that has at least one opening. The sound conduit tube has a shape that has: a sound hole having a first opening through which the sound waves generated by the loudspeaker unit enter, and a second opening from which the sound waves are released and to which the ear tip is connected; and a vent hole formed independently of the sound hole, and having a third opening through which a portion of the sound waves released from the second opening enters and a fourth opening from which the portion of the sound waves is released. The second opening of the sound hole and the third opening of the vent hole are connected to an identical opening of the ear tip.

Advantageous Effects of the Invention

With the earphone disclosed above, since a constant vent hole shape can be maintained regardless of the worn state or the shape of an external auditory canal of an earphone wearer, it is possible to constantly achieve uniform acoustic characteristics.

DESCRIPTION OF EMBODIMENTS

<Findings that Became the Basis of the Present Invention>

Figure 17:
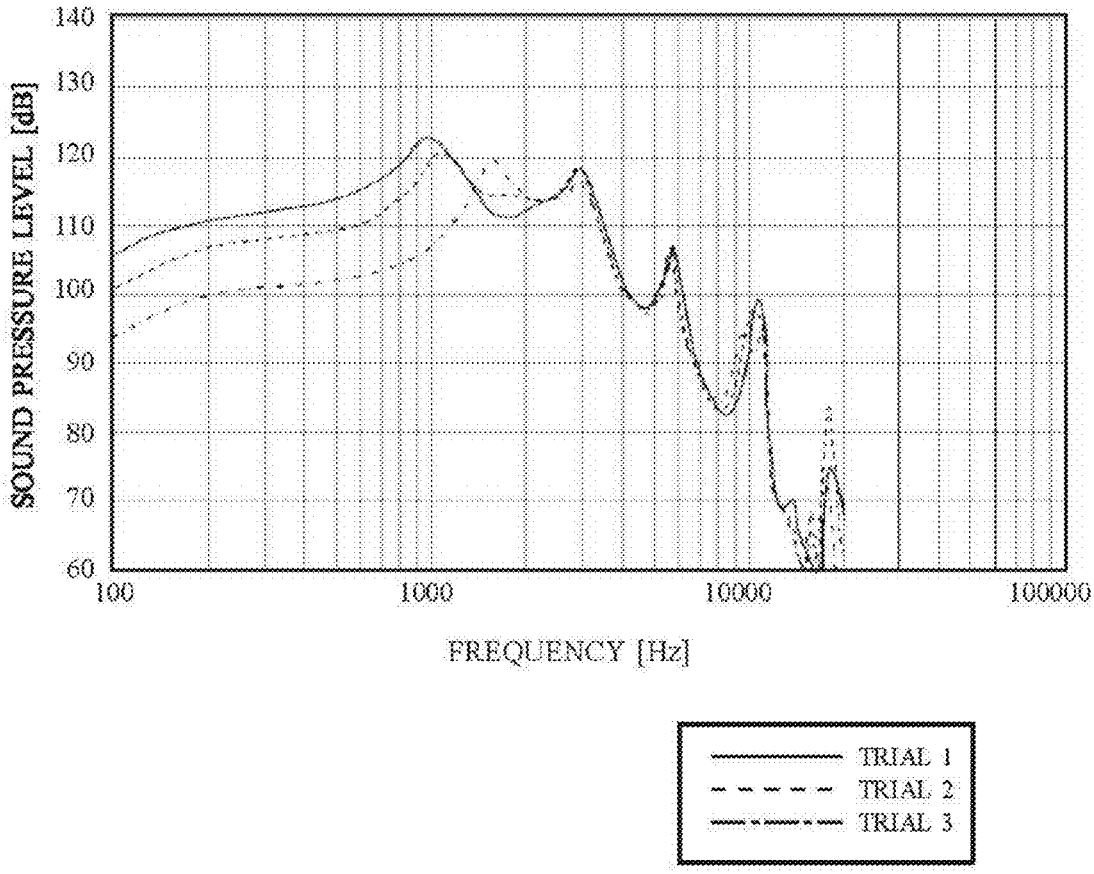
FIG. 17 is for describing the sound-pressure/frequency characteristic of the conventional earphone 200.

As shown in FIG. 17, in the sound-pressure/frequency characteristic observed when three earphone attachment-and-detachment trials have been conducted, it can be confirmed that there is no large differences in high frequency characteristics among the trials, but there is a large difference in low frequency characteristics. This difference in the characteristic is a result of a change in sound waves leaking from a vent hole and an opening of the vent hole, depending on an attachment state of the earphone in an external auditory canal. The reason why the output in the low frequency range changes when compared to that in the high frequency range is because the sound waves in the low frequency range are more strongly influenced by diffraction and can more easily leak out. Therefore, the structure of a conventional open type earphone with a vent hole formed on an ear tip has a problem in that the sound-pressure/frequency characteristic changes depending on the shape of the external auditory canal of an earphone wearer, and on the depth and angle of the inserted ear tip.

<Technique on which the Present Inventors have Focused>

Thus, the present inventors have focused on forming a vent hole at a location other than on an ear tip, and have newly invented an earphone having a structure that does not depend on an attachment state of the earphone in an external auditory canal and that enables the sound-pressure/frequency characteristic to not change easily. It should be noted that, although Patent Literature 2 also shows one example of a structure that is different from the present disclosure but has a vent hole at a location other than on an ear tip; this hitherto known structure has a problem in that the vent hole is connected to the sound hole at a location part way through the sound hole, and sound waves generated by a loudspeaker unit is influenced by the vent hole. Furthermore, the present inventors have further developed the structure having a vent hole at a location other than on an ear tip, and have newly invented an earphone having a structure enabling easy switching between a sealed state and an open state by controlling opening and closing of a vent hole formed at a location other than on an ear tip.

The following sets forth various modes of the present invention based on this new invention.

<General Outline of Various Modes of the Invention>

An earphone according to one mode of the present disclosure based on the invention includes: a loudspeaker unit configured to generate sound waves; a sound conduit tube connected to the loudspeaker unit; and an ear tip connected to the sound conduit tube, and having a shape that has at least one opening. The sound conduit tube has a shape that has: a sound hole having a first opening through which the sound waves generated by the loudspeaker unit enter, and a second opening from which the sound waves are released and to which the ear tip is connected; and a vent hole formed independently of the sound hole, and having a third opening through which a portion of the sound waves released from the second opening enters and a fourth opening from which the portion of the sound waves is released. The second opening of the sound hole and the third opening of the vent hole are connected to an identical opening of the ear tip.

With this one mode, since a constant vent hole shape can be maintained regardless of the worn state or the shape of an external auditory canal of an earphone wearer, it is possible to constantly achieve uniform acoustic characteristics.

In another mode, for example, it is possible to form the fourth opening of the vent hole at a location that is not blocked simultaneously with the third opening, to form the sound hole at the center of the sound conduit tube and form the vent hole independently of the sound hole at an outer circumference thereof, and to form the vent hole at the center of the sound conduit tube and form the sound hole independently of the vent hole at an outer circumference thereof.

With this other mode, the sound waves generated by the loudspeaker unit can be released into the external auditory canal without being influenced by the vent hole.

Furthermore, in another mode, for example, the opening size of the fourth opening of the vent hole can be adjusted by parallelly moving the ear tip along the sound conduit tube, and the opening size of the third opening of the vent hole can also be adjusted by rotationally moving the ear tip around the sound conduit tube.

With this other mode, no matter whether the state is either one of the open state and the sealed state, it is possible to achieve, in both states, a characteristic of not having excessive sound pressure level for the low-pitched sound range with respect to that for the high-pitched sound range.

Furthermore, in another mode, for example, when a loudspeaker unit includes a first sound hole configured to release sound waves into a sound conduit tube and a second sound hole configured to release sound waves having an opposite phase of the sound waves released from the first sound hole; it is also possible to simultaneously adjust opening sizes of the fourth opening and the second sound holes by parallelly moving the ear tip along the sound conduit tube, and to simultaneously adjust opening sizes of the third opening and the second sound hole by rotationally moving the ear tip around the sound conduit tube. Furthermore, when a cover having holes formed thereon corresponding to the first sound hole and the second sound hole is further included; it is also possible to simultaneously adjust the opening sizes of the fourth opening and the second sound hole by parallelly moving the cover along the loudspeaker unit. In such a case, it is possible to have a configuration in which the fourth opening and the second sound hole are both blocked, or in which the third opening and the second sound hole are both blocked.

With this other mode, the sound waves generated by the loudspeaker unit can be released into the external auditory canal without being influenced by the vent hole; and no matter whether the state is either one of the open state and the sealed state, it is possible to achieve, in both states, a characteristic of not having excessive sound pressure level for the low-pitched sound range with respect to that for the high-pitched sound range.

Furthermore, conceivable other modes of the present disclosure include using a magnetic fluid in the loudspeaker unit of the earphone, and including the earphone in hearing aids and headsets.

<Detailed Description of Various Modes of the Invention>

[First Embodiment]

Figure 1:
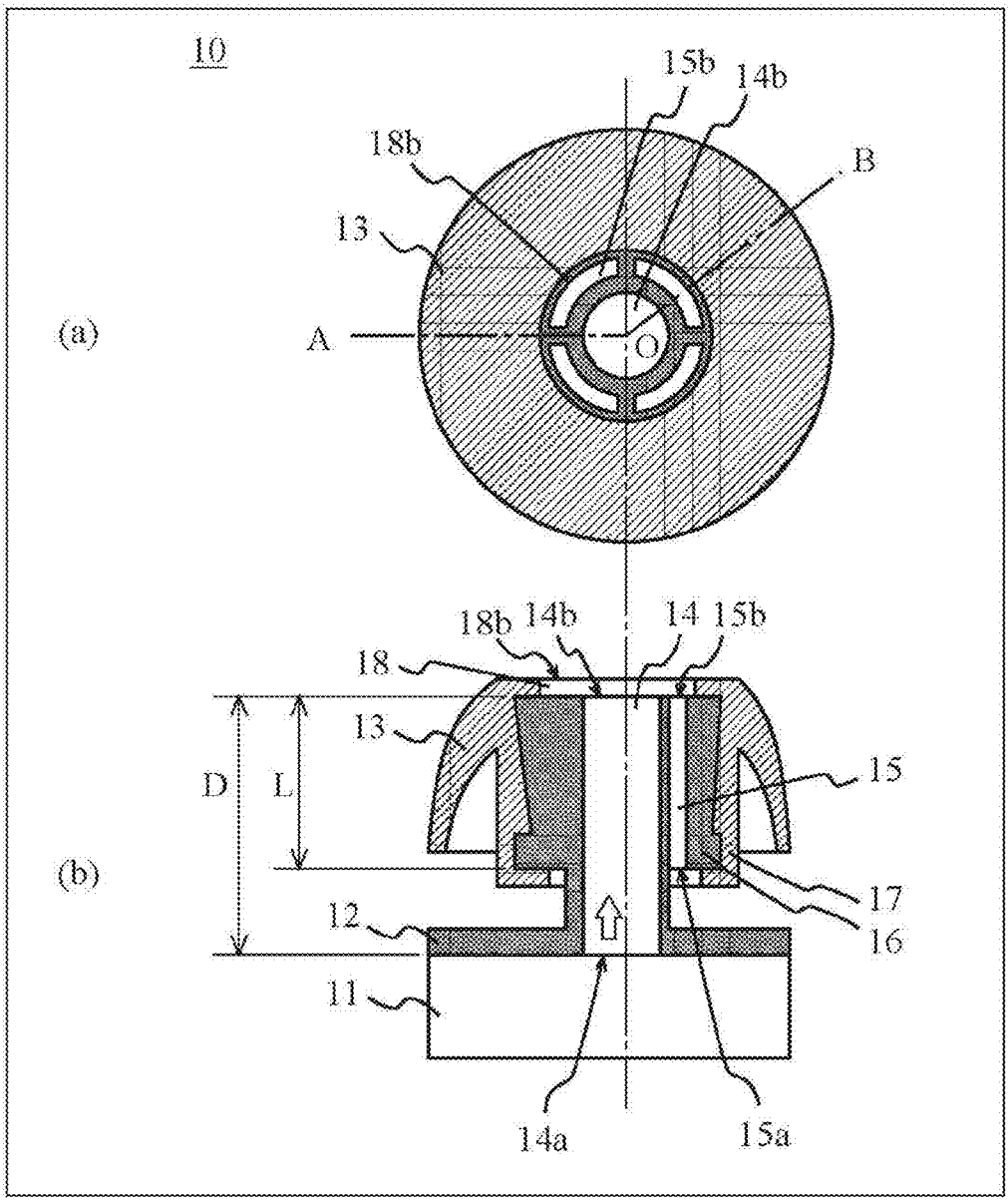
FIG. 1 is a structural drawing of an earphone 10 according to a first embodiment.

FIG. 1 shows a structure of an earphone 10 according to a first embodiment of the present disclosure. In FIG. 1, (a) is a plan view of the earphone 10, and (b) is a cross sectional view along line A-O-B in the earphone 10 shown in (a). The earphone 10 according to the first embodiment includes a loudspeaker unit 11, a sound conduit tube 12, and an ear tip 13.

The loudspeaker unit 11 generates sound waves in a direction of the arrow shown in (b) of FIG. 1, based on signals inputted from an external device (not shown) through a wired or wireless connection.

The sound conduit tube 12 is a substantially tubular component having a sound hole 14 and vent holes 15. The sound hole 14 is formed substantially at the center of the sound conduit tube 12; and the vent holes 15 are formed around the sound hole 14 independently of the sound hole 14. The vent holes 15 illustrated in FIG. 1 are structures obtained by arranging, parallel to the sound hole 14 and at four locations on a concentric circle, circular arc shaped long holes having length L that is shorter than length D of the sound hole 14. It should be noted that, having the vent holes 15 formed at at least one location independently of the sound hole 14 is sufficient, and the shape and the number of the vent holes can be configured freely. A first opening 14*a*, of the sound hole 14 is connected to a part of the loudspeaker unit 11 for generating sound waves. The ear tip 13 is mounted on a second opening lib of the sound hole 14. With regard to the vent holes 15, first openings 15*a* are connected to outside space, and second openings 15*b* are formed on the same surface as the second opening 14*b* of the sound hole 14.

The ear tip 13 is a substantially tubular component that has a dome-shaped umbrella, formed at one end thereof and that has a penetration hole 18. The ear tip 13 becomes fixed to the sound conduit tube 12 when a side of the sound conduit tube 12 having the second opening 14*b* of the sound hole 14 and the second openings 15*b* of the vent holes 15 is inserted in the ear tip 13 from the other end side of the ear tip 13 on which the dome-shaped umbrella is not formed, and when a projected part 16 formed on the outer side surface of the sound conduit tube 12 fits a recessed part 17 formed on the inner side surface of the penetration hole 18 of the ear tip 13. The penetration hole 18 of the ear tip 13 has an opening 18*b* with a shape that allows the second opening 14*b* of the sound hole 14 and the second openings 15*b* of the vent holes 15 to be open, not blocked, when the ear tip 13 is fixed to the sound conduit tube 12. The earphone 10 inserted in an external auditory canal is fixed within the external auditory canal when the dome-shaped umbrella of the ear tip 13 makes contact with the wall surface of the external auditory canal.

In the following, descriptions be provided regarding the action and effect obtained when the earphone 10 according to the first embodiment formed as described above is mounted in an external auditory canal.

Sound waves generated at the loudspeaker unit 11 are released within the external auditory canal via the sound hole 14. Since the sound waves released to the external auditory canal are separated into sound waves propagating to the eardrum and sound waves leaking to outside space from the vent holes 15, the space within the external auditory canal is not in a sealed state. Furthermore, since the vent holes 15 are formed not on the ear tip 13 but on the sound conduit tube 12, the opening size of the vent holes 15 can be maintained at a constant and the output characteristics of the earphone 10 can be maintained uniformly regardless of the shape of the external auditory canal of an earphone-wearer or the depth and angle of the inserted ear tip 13.

Figure 2:
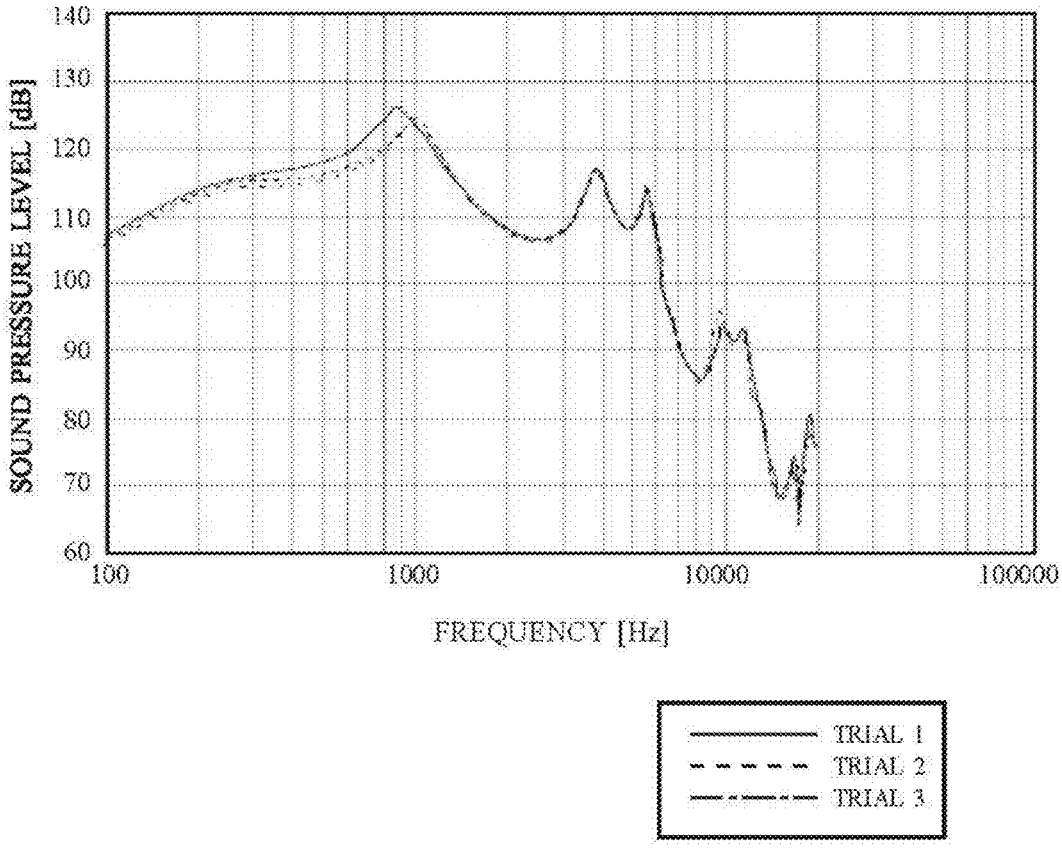
FIG. 2 is for describing the sound-pressure/frequency characteristic of the earphone 10.

For example, FIG. 2 shows the sound-pressure/frequency characteristic of the earphone 10 measured by a microphone installed at an eardrum position of a pseudo-ear on which the earphone 10 of the first embodiment is mounted. In FIG. 2, the horizontal axis represents frequency and the vertical axis represents sound pressure level (SPL), and the sound-pressure/frequency characteristic of the earphone 10 is obtained from three earphone attachment-and-detachment trials. From FIG. 2, it can be confirmed that variability of the characteristic among each of the trials is small when compared to a conventional earphone 200 shown in FIG. 17. When compared to the conventional earphone 200, the difference is particularly obvious in the low frequency range. As shown here, by using the earphone 10 according to the first embodiment, the characteristic can be maintained uniformly in the open state.

Figure 16:
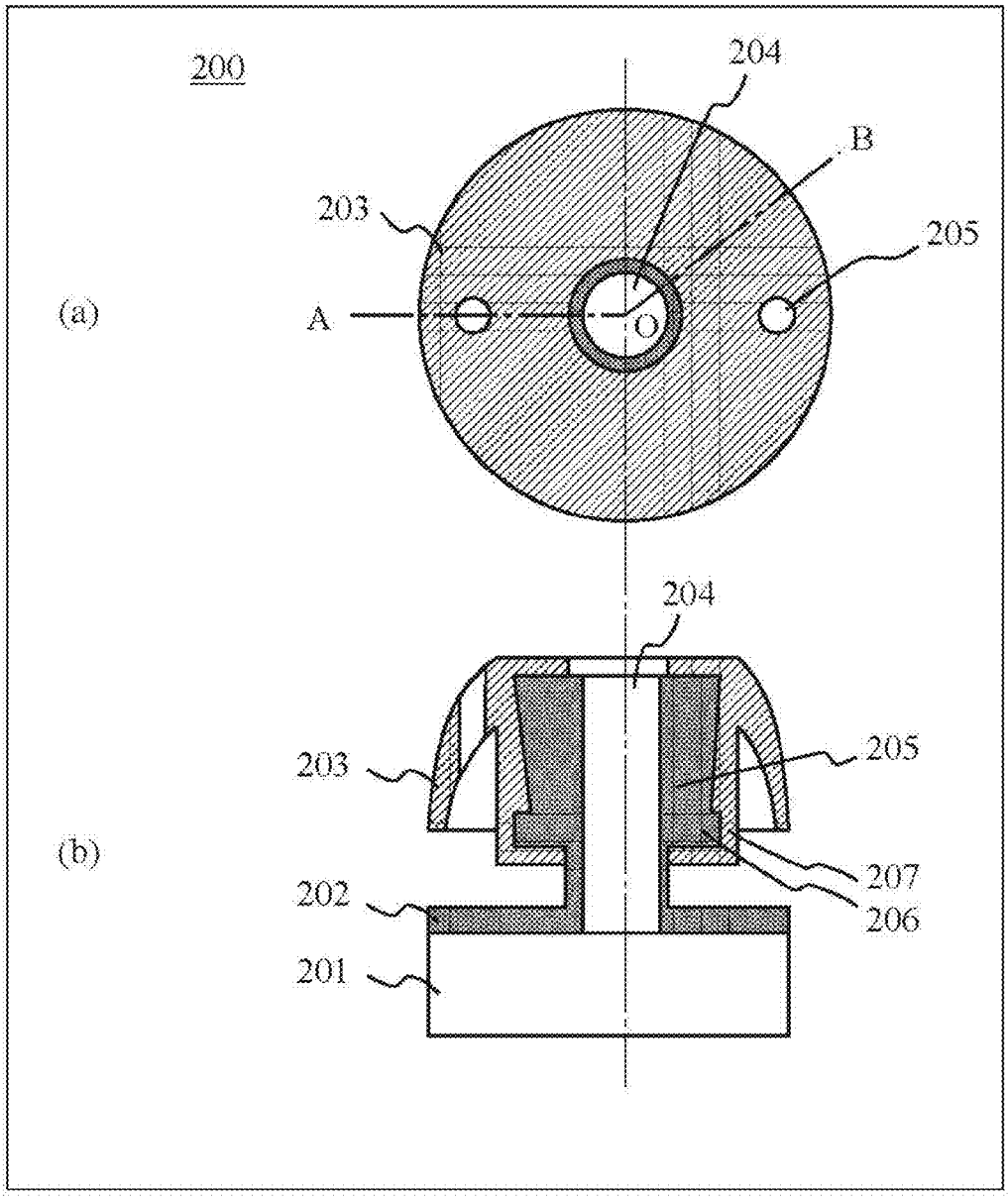
FIG. 16 is a structural drawing of a conventional earphone 200.

Furthermore, in the conventional earphone 200 shown in FIG. 16, since vent holes 205 are formed on an ear tip 203, it is not possible to make the full length of the vent holes 205 longer than the thickness of the dome-shaped umbrella of the ear tip 203. On the other hand, when the earphone 10 according to the first embodiment is used, the length of the vent holes 15 can be extended approximately to the length of the sound conduit tube 12 at maximum. Therefore, with the earphone 10 according to the first embodiment, leakages of sound waves from the vent holes 15 can be adjusted by length L of the vent holes 15.

Figure 3:
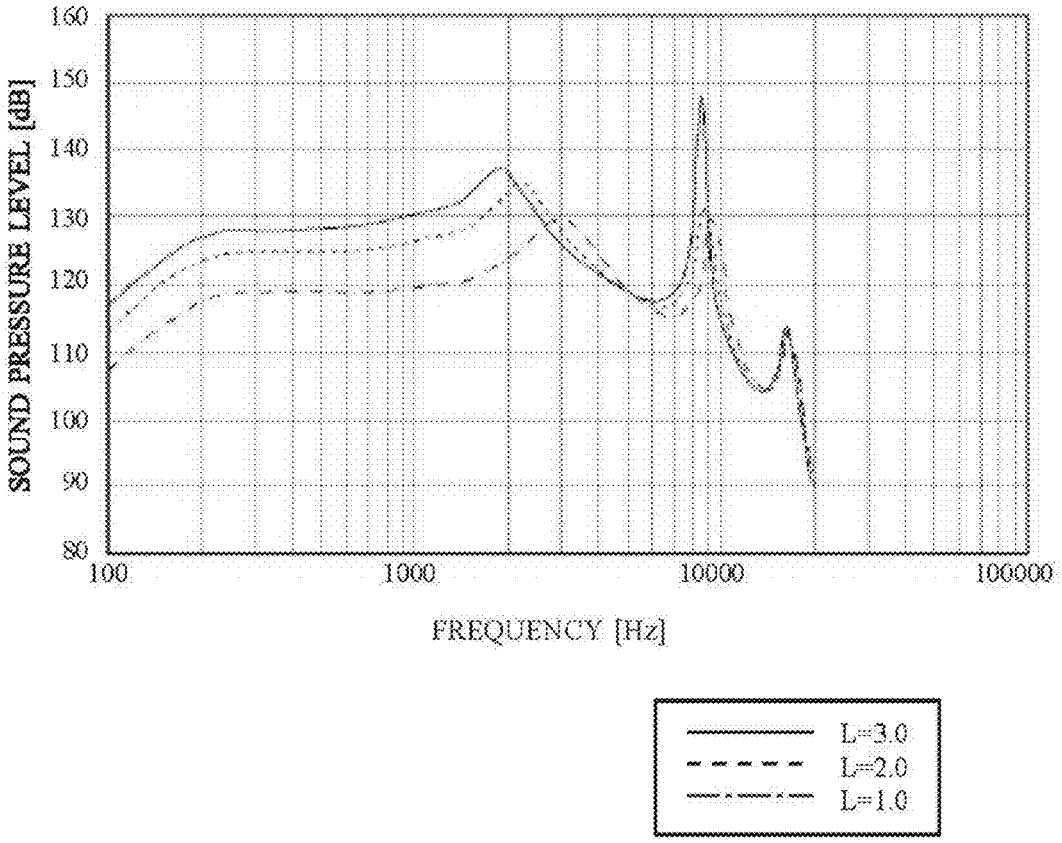
FIG. 3 is for describing the sound-pressure/frequency characteristic of the earphone 10.

FIG. 3 shows a comparison of sound-pressure/frequency characteristics of earphones designed so as to have different full lengths for the vent holes 15 of the earphone 10 according to the first embodiment. In FIG. 3, the horizontal axis represents frequency and the vertical axis represents sound pressure level, and the sound-pressure/frequency characteristics are obtained when the full length of the vent holes 15 having a diameter of ϕ1.8 is changed as 3.0 mm, 2.0 mm, and 1.0 mm. From FIG. 3, it can be confirmed that the characteristic of the low frequency range can be increased by extending length L of the vent holes 15. This is because, when length L of the vent holes 15 is extended, acoustic impedance of the vent holes 15 increases, and leaking of sound waves in the low frequency range becomes suppressed. Therefore, for example, even when the opening size of the vent holes 15 is enlarged in order to enhance ventilation ability of the vent holes 15, it is possible to have a design in advance for suppressing the leaking of sound waves from the vent holes 15 by arbitrarily designing the acoustic impedance of the vent holes 15.

Furthermore, in the earphone 10 according to the first embodiment, the sound hole 14 and the vent holes 15 are formed on the sound conduit tube 12 independently. Here, the meaning of independently forming the sound hole 14 and the vent holes 15 is that sound waves passing through the sound hole 14 does not enter the vent holes 15 directly. Thus, sound waves that have passed through the sound hole 14 are first released in external auditory canal, and then a portion of the sound waves released in the external auditory canal enters the vent holes 15. Furthermore, the meaning of the second openings 15*b* of the vent holes 15 being formed on the same surface as the second opening 14*b* of the sound hole 14 is that they do not necessary have to exist on the completely identical plane but their opening directions are within a predetermined range, i.e., within a range that allows a portion of the sound waves released to the external auditory canal from the sound hole 14 to return to the vent holes 15. Changing the shape and length of the vent holes 15 will not affect the sound hole 14. Therefore, leaking of the sound waves can be controlled without affecting the sound waves released into the external auditory canal.

In addition, only a single penetration hole 18 is formed on the ear tip 13 of the first embodiment. Such a configuration also has an advantageous effect of being able to reduce the time, effort, and cost of a hole-opening process, when compared to the ear tip 203 of the conventional earphone 200 shown in FIG. 16. In addition, the vent holes 205 bored on the ear tip 203 become a factor that causes damage and tear to the ear tip 203. Therefore, the earphone 10 according to the first embodiment can lessen the chances of damage and tear occurring to the ear tip 13 when compared to the conventional earphone 200.

It should be noted that, in the first embodiment, descriptions have been provided regarding a case in which the opening 18*b* is shaped such that, when the ear tip 13 is fixed to the sound conduit tube 12, the second openings 15*b* of the vent holes 15 is not blocked by the penetration hole 18 of the ear tip 13. However, it is also possible to enable mounting, on the sound conduit tube 12, an ear tip having an opening whose opening shape covers one portion of the second openings 15*b* of the vent holes 15. Adjustment of the opening size of the vent holes 15, and suppression of the amount of leakage of sound waves can also be conducted by switching between and using multiple ear tips having different opening shapes for the penetration hole.

[Second Embodiment]

Figure 4:
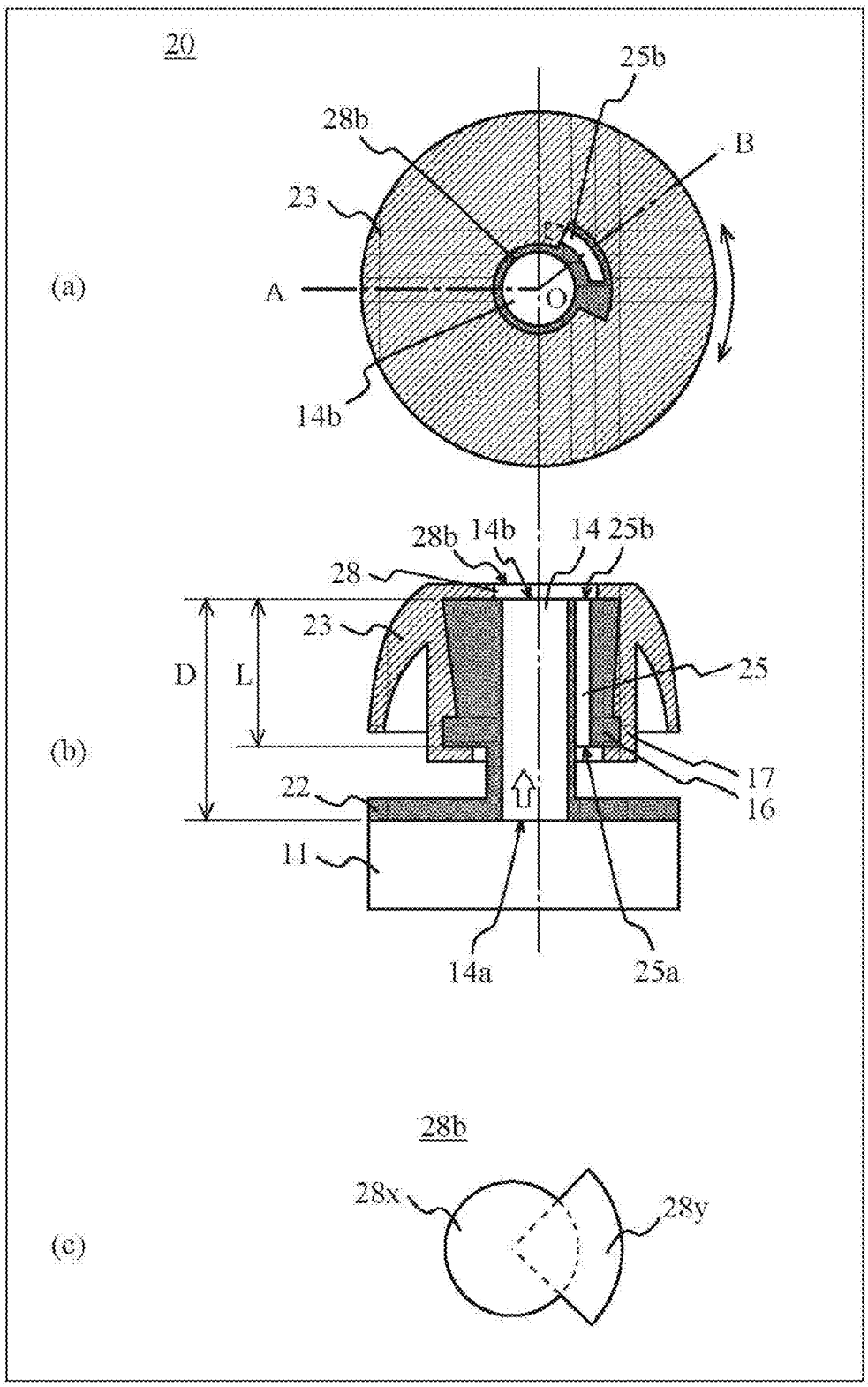
FIG. 4 is a structural drawing of an earphone 20 according to a second embodiment.

FIG. 4 shows a structure of an earphone 20 according to a second embodiment of the present disclosure. In FIG. 4, (a) is a plan view of the earphone 20, (b) is a cross sectional view along line A-O-B in the earphone 20 shown in (a), and (c) shows an opening shape of a penetration hole 28. The earphone 20 according to the second embodiment includes the loudspeaker unit 11, a sound conduit tube 22, and an ear tip 23.

The loudspeaker unit 11 generates sound waves in a direction of the arrow shown in (b) of FIG. 4, based on signals inputted from an external device (not shown) through a wired or wireless connection.

The sound conduit tube 22 is a substantially tubular component having the sound hole 14 and a vent hole 25. The sound hole 14 is formed substantially at the center of the sound conduit tube 22; and the vent hole 25 is formed around the sound hole 14 independently of the sound hole 14. The vent hole 25 illustrated in FIG. 4 is a structure obtained by arranging, parallel to the sound hole 14 and at one location, a circular arc shaped long hole having length L that is shorter than length D of the sound hole 14. It should be noted that, having the vent hole 25 formed at at least one location independently of the sound hole 14 is sufficient, and the shape and the number of the vent hole can be configured freely. The first opening 14*a* of the sound hole 14 is connected to a part of the loudspeaker unit 11 for generating sound waves. The ear tip 23 is mounted on the second opening 14*b* of the sound hole 14. With regard to the vent hole 25, a first opening 25*a* is connected to outside space, and a second opening 25*b* is formed on the same surface as the second opening 14*b* of the sound hole 14.

The ear tip 23 is a substantially tubular component that has a dome-shaped umbrella formed at one end thereof and that has the penetration hole 28. The ear tip 23 becomes fixed to the sound conduit tube 22 when a side of the sound conduit tube 22 having the second opening 14*b* of the sound hole 14 and the second opening 25*b* of the vent hole 25 is inserted in the ear tip 23 from the other end side of the ear tip 23 on which the dome-shaped umbrella is not formed, and when the projected part 16 formed on the outer side surface of the sound conduit tube 22 fits the recessed part 17 formed on the inner side surface of the penetration hole 28 of the ear tip 23. The penetration hole 28 of the ear tip 23 has an opening 28*b* with a shape that allows the second opening 14*b* of the sound hole 14 to be constantly open and that allows the second opening 25*b* of the vent hole 25 to be completely open without being blocked, or to be partially or completely blocked depending on a fixed position, when the ear tip 23 is fixed to the sound conduit tube 22. As one example of such shape of the opening 28*b*, a keyhole-like shape shown in (c) of FIG. 4 is conceivable. In the example in (c) of FIG. 4, the shape is one that is obtained by combining a circular part 28*x* and a sectorial part 28*y*, and the sectorial part 28*y* has a shape corresponding to the cross-sectional shape of the vent hole 25. The earphone 20 inserted in an external auditory canal is fixed within the external auditory canal when the dome-shaped umbrella of the ear tip 23 makes contact with the wall surface of the external auditory canal.

In the following, descriptions will be provided regarding the action and effect obtained when the earphone 20 according to the second embodiment formed as described above is mounted in an external auditory canal.

Similarly to the first embodiment, sound waves generated from the loudspeaker unit 11 are separated into sound waves propagating to the eardrum and sound waves leaking to outside space. A major difference of the earphone 20 according to the second embodiment from the earphone 10 according to the first embodiment is an ability to easily adjust the opening size of the vent hole 25 by rotationally moving the ear tip 23 in a direction of the arrow shown in (a) of FIG. 4 along the outer side wall surface of the sound conduit tube 22. Specifically, by rotationally sliding the ear tip 23 fit on the sound conduit tube 22 and adjusting the overlap of the sectorial part 28*y* and the second opening 25*b* of the vent hole 25, it is possible to achieve any open state ranging from fully open to sealed. With this, the earphone-wearer can adjust the open state in accordance with the surrounding environment and his/her preference.

It should be noted that, in the second embodiment, although the earphone 20 has illustrated to have a single vent hole 25, it may have a plurality of vent holes 25. In addition, the opening shape of the penetration hole 28 of the ear tip 23 may also take any shape (circular shape, elliptical shape, circular arc shape, rectangular shape, etc.), as long as the shape allows changing of the opening size of the vent hole 25 through rotational movement of the ear tip 23. Furthermore, the shape may have a plurality of the sectorial parts 28*y* formed thereon.

[Third Embodiment]

Figure 5:
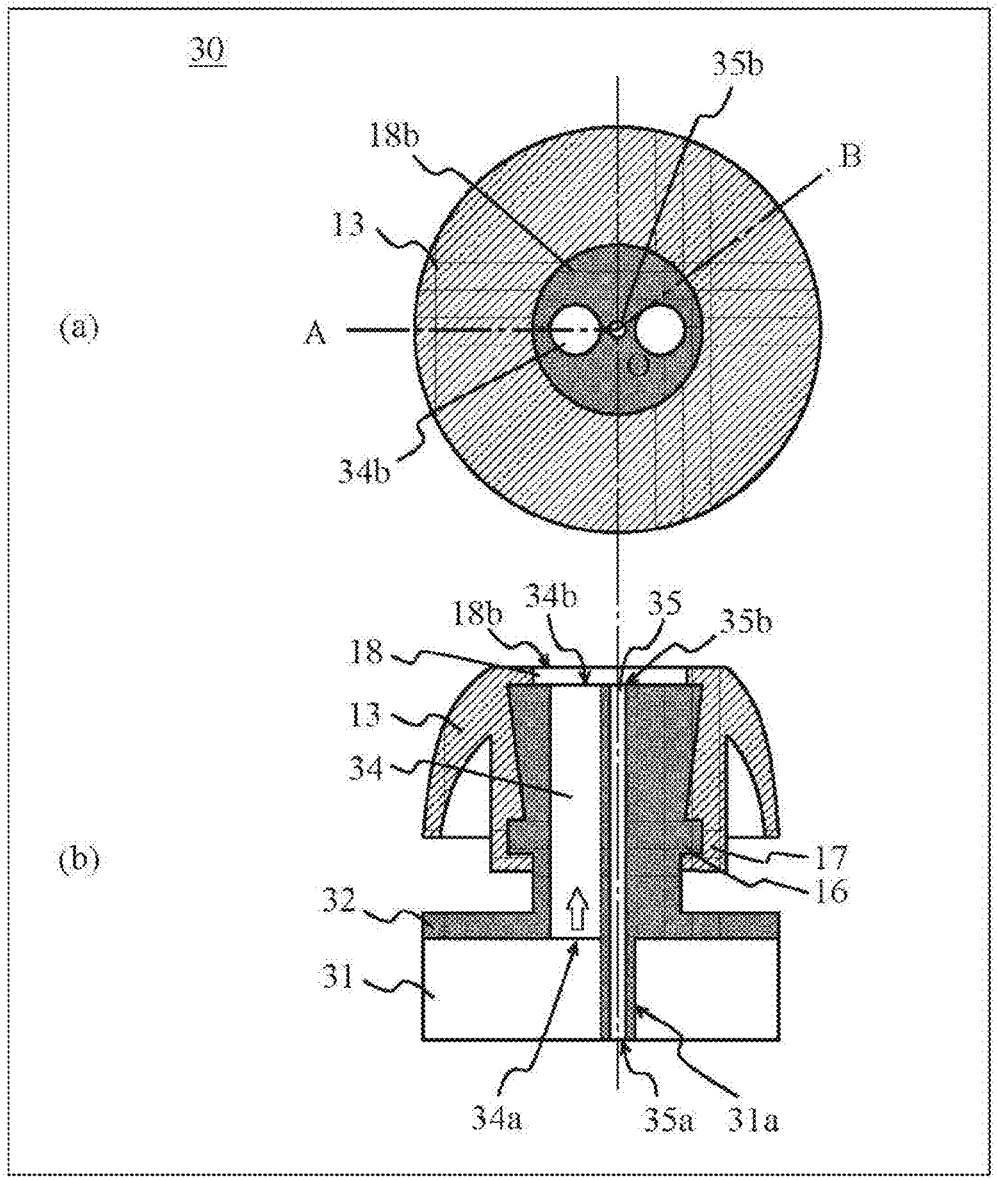
FIG. 5 is a structural drawing of an earphone 30 according to a third embodiment.

FIG. 5 shows a structure of art earphone 30 according to a third embodiment of the present disclosure. In FIG. 5, (a) is a plan view of the earphone 30, and (b) is a cross sectional view along line A-O-B in the earphone 30 shown in (a). The earphone 30 according to the third embodiment includes a loudspeaker unit 31, a sound conduit tube 32, and the ear tip 13.

The loudspeaker unit 31 generates sound waves in a direction of the arrow shown in (b) of FIG. 5, based on signals inputted from an external device (not shown) through a wired or wireless connection. A penetration hole 31*a* penetrating the loudspeaker unit 31 is formed substantially at the center of the loudspeaker unit 31. It should be noted that the loudspeaker unit 31 may be formed from two or more units.

The sound conduit tube 32 is a substantially tubular component having sound holes 34 and a vent hole 35 that are independent from each other. The vent hole 35 is formed at a location corresponding to the penetration hole 31*a* of the loudspeaker unit 31. The sound conduit tube 32 illustrated in FIG. 5 has a structure in which the vent hole 35 is formed at a single location substantially at the center of the sound conduit tube 32 and in which the sound holes 34 are arranged parallel to the vent hole 35 at two locations around the vent hole 35. It should be noted that, having the vent hole 35 formed at at least one location independently of the sound holes 34 is sufficient, and the shape and the number of the vent hole can be configured freely. First openings 34*a* of the sound holes 34 are connected to locations where sound waves are generated by the loudspeaker unit 31. The ear tip 13 is mounted on second openings 34*b* of the sound holes 34. With regard to the vent hole 35, a first opening 35*a* is connected to outside space, and a second opening 35*b* is formed on the same surface as the second openings 34*b* of the sound holes 34.

The ear tip 13 is a substantially tubular component that has a dome-shaped umbrella formed at one end thereof and that has the penetration hole 18. The ear tip 13 becomes fixed to the sound conduit tube 32 when a side of the sound conduit tube 32 having the second openings 34*b* of the sound holes 34 and the second opening 35*b* of the vent hole 35 is inserted in the ear tip 13 from the other end side of the ear tip 13 on which the dome-shaped umbrella is not formed, and when the projected part 16 formed on the outer side surface of the sound conduit tube 32 fits the recessed part 17 formed on the inner side surface of the penetration hole 18 of the ear tip 13. The penetration hole 18 of the ear tip 13 has the opening 18*b* with a shape that allows the second openings 34*b* of the sound holes 34 and the second opening 35*b* of the vent hole 35 to be open, not blocked, when the ear tip 13 is fixed to the sound conduit tube 32. The earphone 30 inserted in an external auditory canal is fixed within the external auditory canal when the dome-shaped umbrella of the ear tip 13 makes contact with the wall surface of the external auditory canal.

In the following, descriptions will be provided regarding the action and effect obtained when the earphone 30 according to the third embodiment formed as described above is mounted in an external auditory canal.

Similarly to the first embodiment, sound waves generated from the loudspeaker unit 31 are separated into sound waves propagating to the eardrum and sound waves leaking to outside space. A major difference of the earphone 30 according to the third embodiment from the earphone 10 according to the first embodiment is having the vent hole 35 being formed substantially at the center of the sound conduit tube 32. With this, length of the vent hole 35 can be extended to about the full length of the earphone 30. As a result, the acoustic impedance of the vent hole 35 can be further increased, and the amount of leakage of the sound waves can be adjusted by the length of the vent hole 35.

[Fourth Embodiment]

In the first to third embodiments, descriptions have been provided for the open type earphones 10, 20, and 30. Disclosed in the following embodiments are earphones having structures enabling switching between a sealed state and an open state by controlling opening and closing of a vent hole formed at a location other than on an ear tip.

Figure 6:
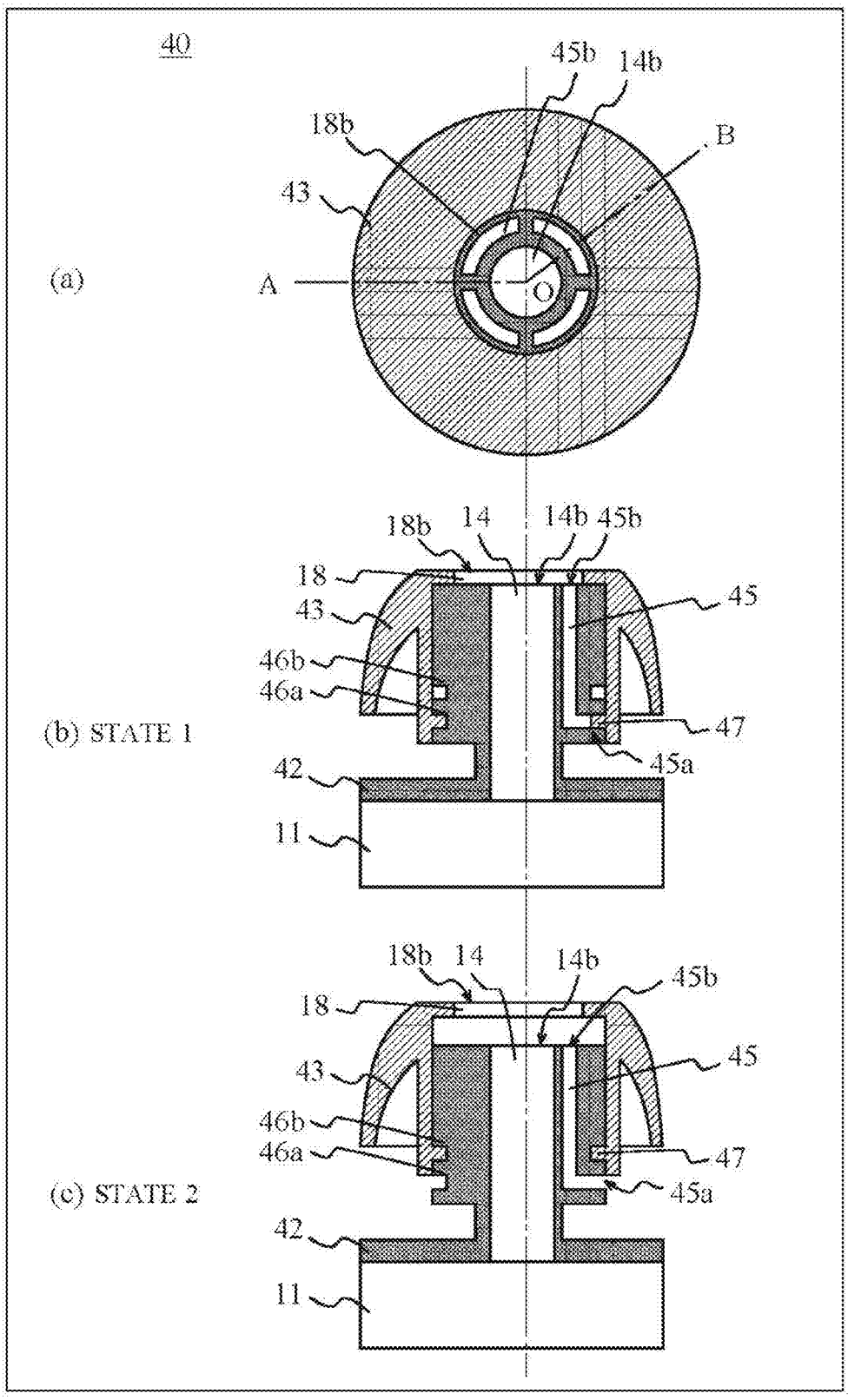
FIG. 6 is a structural drawing of an earphone 40 according to a fourth embodiment.

FIG. 6 shows a structure of an earphone 40 according to a fourth embodiment of the present disclosure. In FIG. 6, (a) is a plan view of the earphone 40, and (b) and (c) are cross sectional views along line A-O-B in the earphone 40 shown in (a). The earphone 40 according to the fourth embodiment includes the loudspeaker unit 11, a sound conduit tube 12, and an ear tip 43.

In order to be used both as a sealed type and an open type, the earphone 40 according to the fourth embodiment has, as a feature, a function of fitting the sound conduit tube 12 and the ear tip 13 of the earphone 10 according to the first embodiment. Therefore, the shapes of the sound conduit tube 42 and the ear tip 43 of the earphone 40 are slightly different from the shapes of the sound conduit tube 12 and the ear tip 13 of the earphone 10. In the following, descriptions of the earphone 40 will be provided centered on the different shapes.

It should be noted that, configurations of the earphone 40 according to the fourth embodiment identical to those of the earphones 10, 20, and 30 according to the first to third embodiments are given the same reference characters, and descriptions thereof are omitted.

The sound conduit tube 42 is a substantially tubular component having the sound hole 14 and vent holes 45. The sound hole 14 is identical to the sound hole of the earphone 10. Although the vent holes 45 are equivalent to the vent holes 15 of the earphone 10 in terms of their function and condition, a feature of the vent holes 45 is having first openings 45*a* connected to outside space formed on the outer side surface of the sound conduit tube 42. In addition, a feature of the sound conduit tube 42 is having, on the outer side surface thereof, a first recessed part 46*a* including the first openings 45*a* of the vent holes 45, and a second recessed part 46*b* having the same shape as the first recessed part 46*a*. It should be noted that, the first recessed part 46*a* and/or the second recessed part 46*b* may be formed to circle around the outer side surface of the sound conduit tube 42 so as to form a groove, or may be formed as a plurality of depressions.

The ear tip 43 is a substantially tubular component that has a dome-shaped umbrella formed at one end thereof and that has the penetration hole 18. The ear tip 43 is equivalent to the ear tip of the earphone 10 in terms of its acoustic function, but is different in the structure for fitting onto the first recessed part 46*a* and the second recessed part 46*b* formed on the sound conduit tube 42. A feature of the penetration hole 18 of the ear tip 43 is having, on an inner side surface thereof, a projected part 47 corresponding to the location of the first openings 45*a* of the vent holes 45.

In the following, the structure of the earphone 40 according to the fourth embodiment formed as described above will be set forth. The earphone 40 can take the following two states.

The first of the two states is "state 1" ((b) of FIG. 6) in which the ear tip 43 is inserted to the deepest end of the sound conduit tube 42 such that the projected part 47 of the penetration hole 18 of the ear tip 43 fits the first recessed part 46*a* of the sound conduit tube 42. In this state 1, the vent holes 45 of the sound conduit tube 42 are blocked by the ear tip 43, resulting in a sealed state in which leaking of sound waves is blocked.

The second of the two states is "state 2" ((c) of FIG. 6) in which the ear tip 43 is pulled out toward the near side from the deepest end of the sound conduit tube 42, i.e., moved parallel along the outer side wall surface of the sound conduit tube 42, such that the projected part 47 of the penetration hole 18 of the ear tip 43 fits the second recessed part 46*b* of the sound conduit tube 42. In this state 2, the vent holes 45 of the sound conduit tube 42 are not blocked by the ear tip 43, resulting in an open state in which sound waves can leak out freely.

With such a structure allowing switching between state 1 and state 2, a user can freely select the proper usage state in accordance with the surrounding environment and his/her preference in cases such as, for example, when noise in the surrounding environment is large, when suppression of sound leakage from the earphone is desired, and when an inflow of external sounds is desired. Selecting state 2 results in the open state that will not cause a problem of making the user's wearing sensation unpleasant due to confining of produced sound within the external auditory canal, i.e., reverberation of self-generated sounds, and due to stuffiness in the external auditory canal resulting from long-term use. Furthermore, the open state will not result in excessive deterioration the low frequency characteristic.

[Fifth Embodiment]

Figure 7:
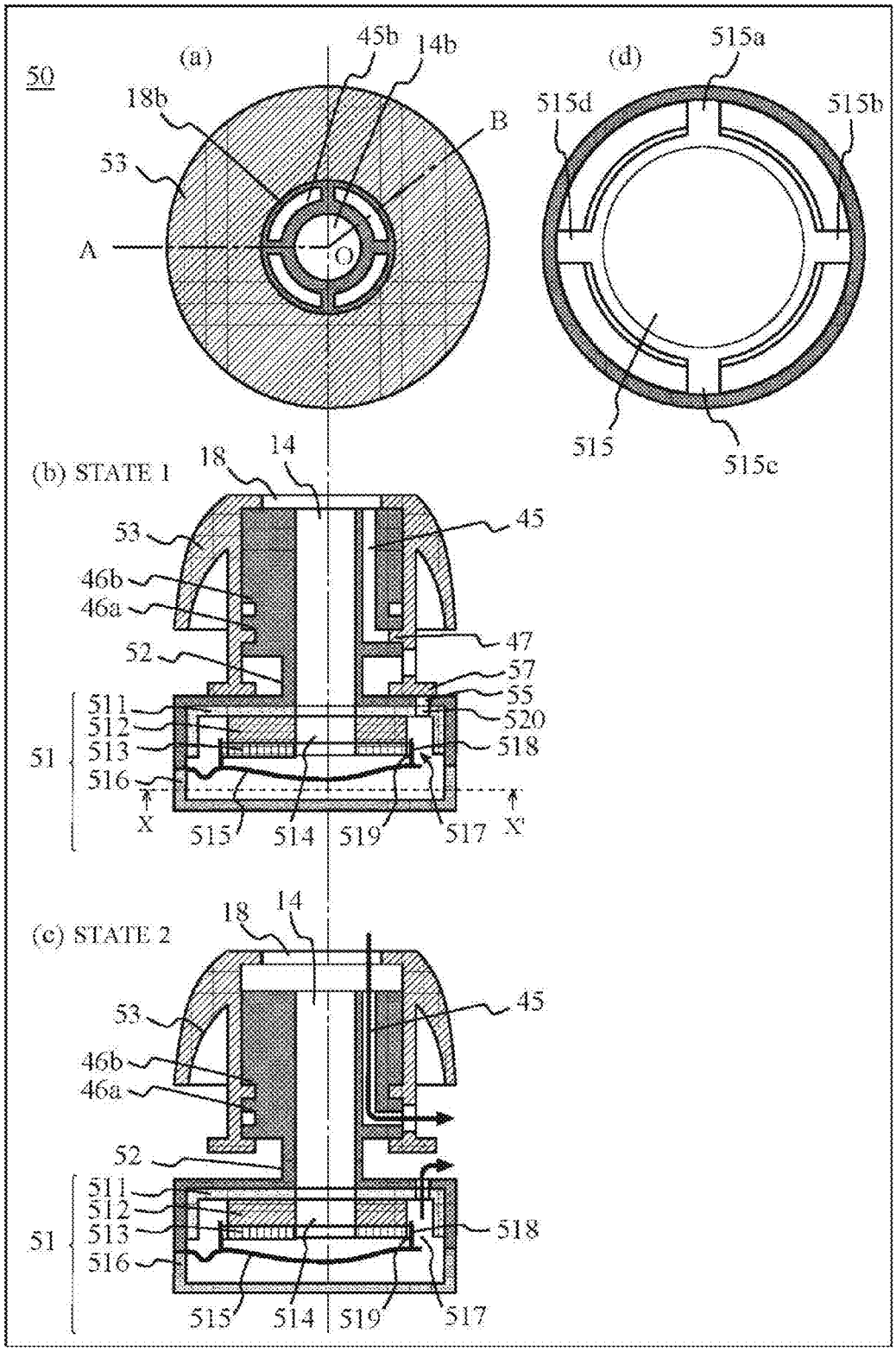
FIG. 7 is a structural drawing of an earphone 50 according to a fifth embodiment.

FIG. 7 shows a structure of an earphone 50 according to a fifth embodiment of the present disclosure. In FIG. 7, (a) is a plan view of the earphone 50, (b) and (c) are cross sectional views along line A-O-B in the earphone 50 shown in (a), and (d) is across sectional view along line X-X' in the earphone 50 shown in (b). The earphone 50 according to the fifth embodiment includes a loudspeaker unit 51, a sound conduit tube 52, and an ear tip 53.

In order to be used both as a sealed type and an open type, the earphone 50 according to the fifth embodiment also has, as a feature, the function of fitting the sound conduit tube 52 and the ear tip 53. However, in addition to the functions of the earphone 40 according to the fourth embodiment, the earphone 50 also has, as a feature, an ability to control opening and closing of the sound hole of the loudspeaker unit 51. In the following, descriptions of the earphone 50 will be provided centering on this feature.

It should be noted that, configurations of the earphone 50 according to the fifth embodiment identical to those of the earphones 10, 20. 30, and 40 according to the first to fourth embodiments are given the same reference characters, and descriptions thereof are omitted.

The loudspeaker unit 51 includes: a yoke 511; a magnet 512; a plate 513; a diaphragm 515 having supports 515*a*, 515*b*, 515*c*, and 515*d*; a cover 516; a voice coil 518; and a magnetic fluid 519.

A first sound hole 514 is formed through the centers of the yoke 511, the magnet 512, and the plate 513. In addition, a second sound hole 520 is formed at one part of the yoke 511. The diaphragm 515 is supported by the four supports 515*a*, 515*b*, 515*c*, and 515*d* in a vibratable manner. The cross-sections of the supports 515*a*, 515*b*, 515*c*, and 515*d* have, for example, a roll shape. The number and location of the supports 515*a*, 515*b*, 515*c*, and 515*d* shown in (d) of FIG. 7 are examples, and can be configured freely. For example, when supports surrounding the perimeter of the diaphragm 515 are used, the second sound hole 520 may be formed at one part of the cover 516. Space is formed between the cover 516 and the diaphragm 515, and the cover 516 is connected to the sound conduit tube 52. The voice coil 518 is connected, at one end thereof, to the diaphragm 515, and is held within a magnetic gap 517 formed by the yoke 511 and the plate 513. In addition, the space between the voice coil 518 and the plate 513 is filled with the magnetic fluid 519. It should be noted that the magnetic fluid 519 is not an essential component. If the magnetic fluid 519 is not used, the supports surrounding the perimeter of the diaphragm 515 are used as described above. The sound conduit tube 52 is connected to the yoke 511 and the cover 516. Furthermore, a second vent hole 55 is formed on the sound conduit tube 52 in addition to and independent of the sound hole 14 and the first vent holes 45.

The sound conduit tube 52 is a substantially tubular component having the sound hole 14, the first vent holes 45, and the second vent hole 55. The sound hole 14 is identical to the sound hole of the earphone 10. The first vent holes 45 are identical to the vent holes of the earphone 40. The second vent hole 55 is formed corresponding to the second sound hole 520 of the yoke 511. In addition, the first recessed part 46*a* and the second recessed part 46*b* formed on the outer side surface of the sound conduit tube 52 are identical to the respective recessed parts of the earphone 40. The location of the sound hole 14 of the sound conduit tube 52 matches the location of the first sound hole 514 of the loudspeaker unit 51.

The ear tip 53 is a substantially tubular component that has a dome-shaped umbrella formed at one end thereof and that has the penetration hole 18. The ear tip 53 is equivalent to the ear tip of the earphone 40 in terms of its acoustic function, but is different in the structure for fitting onto the second sound hole 520 of the loudspeaker unit 51. Features of the penetration hole 18 of the ear tip 53 include having, on the inner side surface thereof, the projected part 47 at a location corresponding to the first vent holes 45, and having a lid part 57 at a location corresponding to the second vent hole 55.

In the following, descriptions will be provided regarding the structure of the earphone 50, and the action and effect obtained when the earphone 50 according to the fifth embodiment formed as described above is mounted in an external auditory canal. The earphone 50 can take the following two states.

It should be noted that, when electrical signals are inputted to the voice coil 518, the voice coil 518 vibrates in accordance with the Fleming's left hand rule, and sound waves are generated from the diaphragm 515 adjoining thereto; however since the principle behind that is general technology, description of it is omitted. Furthermore, the fact that sound waves released from the first sound hole 514 and sound waves released from the second sound hole 520 being in opposite phase of each other is general technology and description thereof is omitted.

The first of the two states is "state 1" ((b) of FIG. 7) in which the ear tip 53 is inserted to the deepest end of the sound conduit tube 52 such that the projected part 47 of the penetration hole 18 of the ear tip 53 fits the first recessed part 46*a* of the sound conduit tube 52 and that the lid part 57 covers the second vent hole 55 of the loudspeaker unit 51. In this state 1, the first vent holes 45 of the sound conduit tube 52 and the second vent hole 55 of the loudspeaker unit 51 are blocked by the ear tip 53, resulting in a sealed state in which leaking of sound waves is blocked.

Sound waves generated at the diaphragm 515 are released into the external auditory canal via the first sound hole 514 and the sound hole 14. Since the space inside the external auditory canal is in a sealed state by the projected part 47, if the second sound hole 520 is connected to outside space, the minimum resonant frequency of the earphone 50 becomes about several-hundred Hz, and the sound pressure level in the low-pitched sound range largely exceeds the sound pressure level in the high-pitched sound range. Therefore, in the earphone 50 according to the fifth embodiment, in order to increase the minimum resonant frequency, the connection between outside space and the second sound hole 520 (the second vent hole 55) is blocked by the lid part 57 to obtain a sealed state for the space between the diaphragm 515 and the cover 516. With this, since the minimum resonant frequency of the earphone 50 increases due to an increase in stiffness of the space between the diaphragm 515 and the cover 516, the sound pressure level of the low-pitched sound range can be prevented from largely exceeding the sound pressure level of the high-pitched sound range.

The second of the two states is "state 2" ((c) of FIG. 7) in which the ear tip 53 is pulled out toward the near side from the deepest end of the sound conduit tube 52, such that the projected part 47 of the penetration hole 18 of the ear tip 53 fits the second recessed part 46*b* of the sound conduit tube 52 and that the second vent hole 55 of the loudspeaker unit 51 is not covered by the lid part 57 but is open. In this state 2, the first vent holes 45 of the sound conduit tube 52 and the second vent hole 55 of the loudspeaker unit 51 are both not blocked by the ear tip 53, resulting in an open state in which sound waves can leak out freely.

Sound waves generated at the diaphragm 515 are released into the external auditory canal via the first sound hole 514 and the sound hole 14. Since the first vent holes 45 of the sound conduit tube 52 are open, sound waves released into the external auditory canal are separated into sound waves propagating to the eardrum and sound waves leaking from the first vent holes 45 to outside space of the ear tip 53. Thus, the space inside the external auditory canal is not in a sealed state. Furthermore, since the magnetic gap 517 is connected to outside space by the second sound hole 520 and the second vent hole 55, it is possible to suppress an increase in stiffness of the space between the diaphragm 515 and the cover 516. As a result, the minimum resonant frequency of the earphone 50 can be prevented from increasing. With this, deterioration of the low-pitched sound range characteristic can be suppressed even in the open state in which sound leakage from the first vent holes 45 occurs. Therefore, since the second sound hole 520 and the second vent hole 55 are open, the low-pitched sound range characteristic can be maintained at a level equivalent to that of the high-pitched sound range characteristic.

With such a structure allowing switching between state 1 and state 2, a user can freely select the proper usage state in accordance with the surrounding environment and his/her preference, in cases such as, for example, when noise in the surrounding environment is large, when suppression of sound leakage from the earphone is desired, and when an inflow of external sounds is desired. In addition, since the sealed state in which state 1 is selected increases the minimum resonant frequency of the earphone 50 due to blocking of the second vent hole 55, it is possible to achieve, in both sealed and open states, a characteristic of not having excessive sound pressure level for the low-pitched sound range with respect to that for the high-pitched sound range.

Here, in order to confirm the advantageous effect of the present embodiment, sound-pressure/frequency characteristic will be compared in the following three types of earphones. In the respective figures, the horizontal axis represents frequency and the vertical axis represents sound pressure level.

Figure 10:
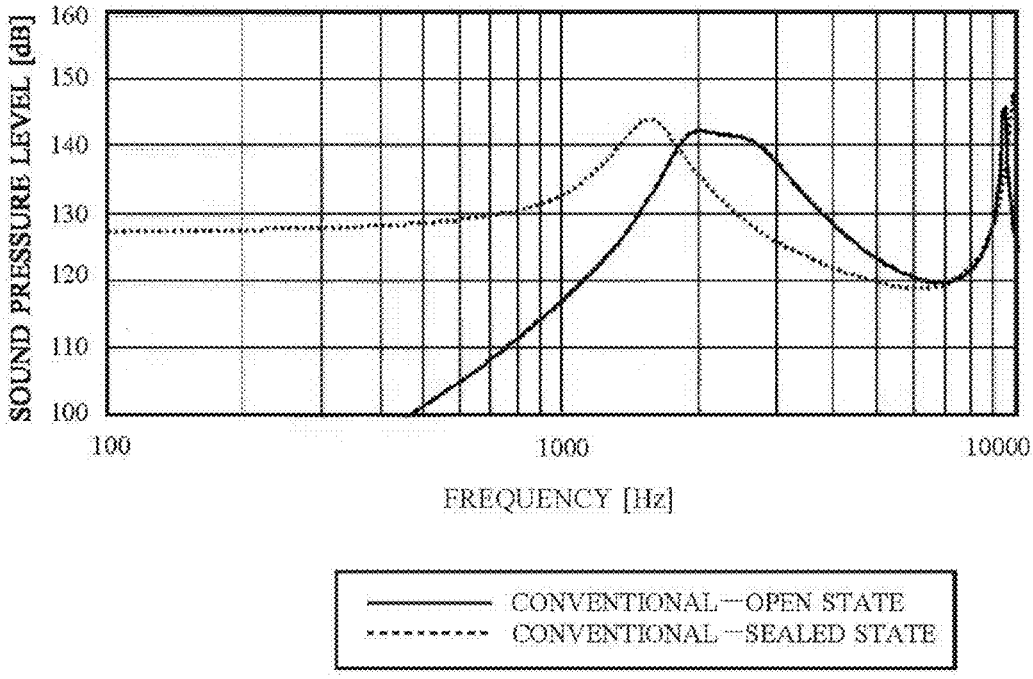
FIG. 10 is for describing the sound-pressure/frequency characteristic of a conventional earphone.

(1) FIG. 10: Functions equivalent the first vent holes 45 are added to a conventional earphone (the whole circumference of the diaphragm is supported by supports, and a magnetic fluid is not used), and the vent holes are sealed and opened.

Figure 8:
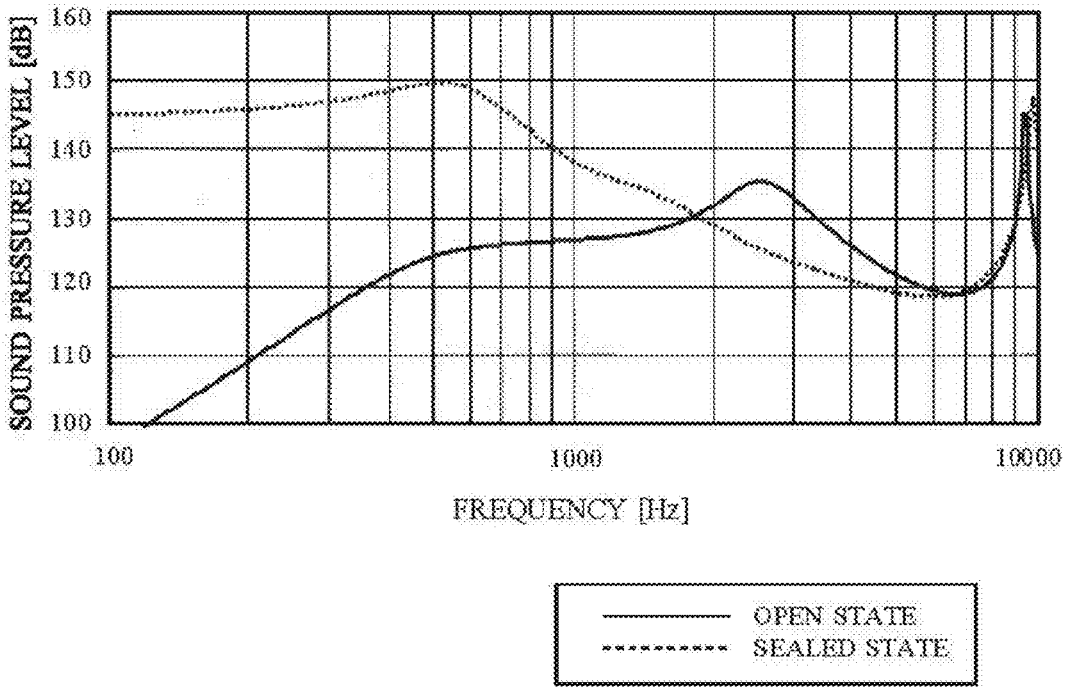
FIG. 8 is for describing the sound-pressure/frequency characteristic of the earphone 50 under different conditions.

(2) FIG. 8: The earphone 50 (the diaphragm is partially supported by the supports, the magnetic fluid is used; and the second vent hole 55 is constantly open) of the present embodiment is used, and only the first vent holes 45 are sealed and opened.

Figure 9:
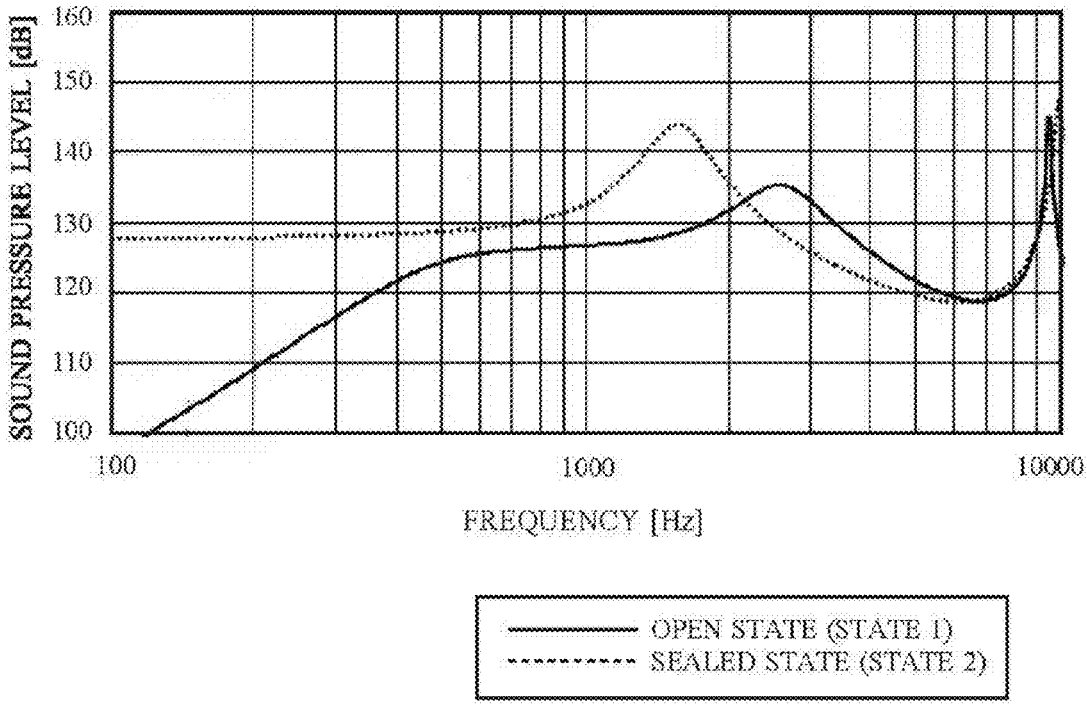
FIG. 9 is for describing the sound-pressure/frequency characteristic of the earphone 50.

(3) FIG. 9: The earphone 50 (the diaphragm is partially supported by the supports, and the magnetic fluid is used) of the present embodiment is used, and the first vent holes 45 and the second vent hole 55 are sealed and opened.

First, with respect to (1), FIG. 10 shows the sound-pressure/frequency characteristic of the earphone when the function equivalent to the first vent holes 45 is in an open state (solid line) and in a sealed state (dotted line). It can be understood from FIG. 10 that, with the structure of the conventional earphone, the low frequency range characteristic is deteriorated in the open state. This is caused because of having a high minimum resonant frequency F0 due to a large stiffness of the support system in the general earphone. Since sound waves having a lower frequency have a feature of spreading into space more, characteristics deteriorate mainly in the low-pitched sound range when holes such as the first vent holes 45 are formed.

Next, with respect to (2), FIG. 8 shows the sound-pressure/frequency characteristic of the earphone when the first vent holes 45 are in an open state (solid line) and in a sealed state (dotted line). Regarding the characteristic of the earphone 50 in which the second vent hole 55 is constantly open, it can be understood from FIG. 8 that the characteristic deteriorates in the open state at frequencies of 500 Hz or below, but the difference in sound pressure level in a bandwidth from 500 Hz to 9 kHz is within 10 dB. Thus, the low frequency characteristic in the open state is improved when compared to (1). On the other hand, in the sealed state, the characteristic at 500 Hz or below is about 20 dB larger when compared to the characteristic at 2 kHz or above, resulting in an excessive characteristic in the low-pitched sound range. Thus, when the second vent hole 55 is constantly connected to outside space, it is not possible to achieve the characteristic of not having excessive sound pressure level for the low-pitched sound range in the sealed/open state.

Furthermore, with respect to (3), FIG. 9 shows the sound-pressure/frequency characteristic of the earphone 50 when the first vent holes 45 and the second sound hole 55 are in open state 1 (solid line), and in sealed state 2 (dotted line). It can be understood from FIG. 9 that, with the earphone 50 according to the present embodiment, similarly to (2), the difference in sound pressure level between the low-pitched sound range and the high-pitched sound range in the open state is within 10 dB. In addition, since the second vent hole 55 is blocked in the sealed state, the minimum resonant frequency of the earphone 50 increases, and an excess in the low-pitched sound range does not occur as in the sealed state of (2). Thus, by adjusting the connection between the second vent hole 55 and outside space in accordance with the state of the first vent holes 45, it is possible in the present embodiment to improve the low frequency characteristic in the open state and constantly achieve characteristics of not having excessive sound pressure level for the low-pitched sound range.

[Sixth Embodiment]

Figure 11:
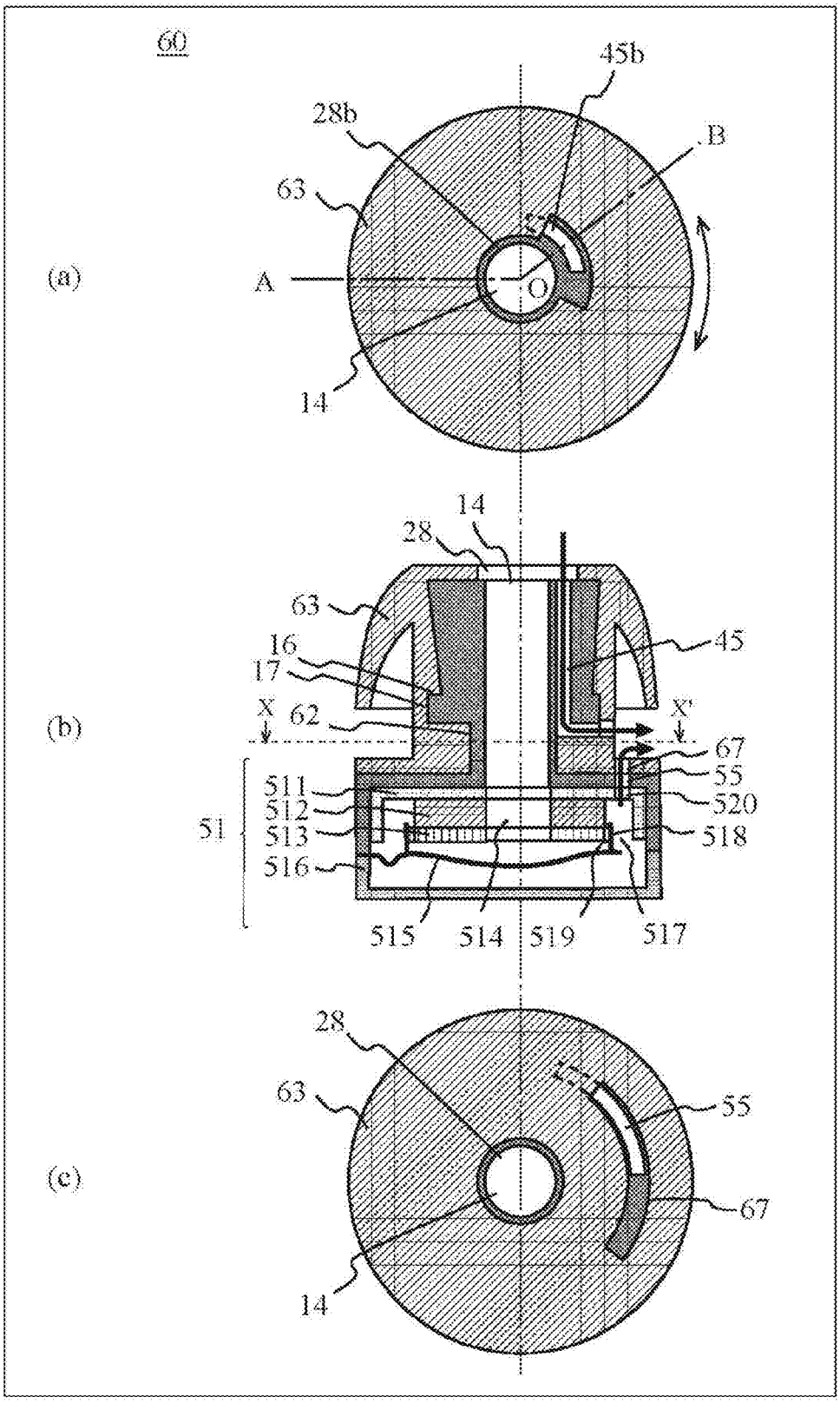
FIG. 11 is a structural drawing of an earphone 60 according to a sixth embodiment.

FIG. 11 shows a structure of an earphone 60 according to a sixth embodiment of the present disclosure. In FIG. 11, (a) is a plan view of the earphone 60, (b) is across sectional view along line A-O-B in the earphone 60 shown in (a), and (c) is a cross sectional view along X-X' in the earphone 60 shown in (b). The earphone 60 according to the sixth embodiment includes the loudspeaker unit 51, a sound conduit tube 62, and an ear tip 63.

In order to be used both as a scaled type and an open type, the earphone 60 according to the sixth embodiment also has, as a feature, the function of fitting the sound conduit tube 62 and the ear tip 63. However, in addition the functions of the earphone 20 according to the second embodiment, the earphone 60 also has, as a feature, an ability to control opening and closing of the sound hole of the loudspeaker unit 51, similarly to the fifth embodiment. In the following, descriptions of the earphone 60 will be provided centered on this feature.

It should be noted that, configurations of the earphone 60 according to the sixth embodiment identical to those of the earphones 10, 20, 30, 40, and 50 according to the first to fifth embodiments are given the same reference characters, and descriptions thereof are omitted.

The sound conduit tube 62 is a substantially tubular component having the sound hole 14, a first vent hole 45, and the second vent hole 55. The sound hole 14, the first vent hole 45, and the second vent hole 55 are identical to the sound holes of the earphones 10, 40, and 50, respectively. Illustrated in (c) of FIG. 11 is the second vent hole 55 having a structure of a circular arc shaped long hole arranged at one location. In addition, the projected part 16 that is to be fitted to the ear tip 63 is formed on the outer side surface of the sound conduit tube 62.

The ear tip 63 is a substantially tubular component that has a dome-shaped umbrella formed at one end thereof and that has the penetration hole 28. The acoustic function of the ear tip 63 is equivalent to that of the ear tip of the earphone 20. The recessed part 17 to be fit with the sound conduit tube 62 is formed on the inner side surface of the penetration hole 28. In addition, formed on the ear tip 63 at a location that makes contact with the sound conduit tube 62 is a vent hole 67 having an opening shape that allows the second sound hole 520 to be partially or completely blocked, or to be completely open without being blocked depending on a fixed position when the ear tip 63 is fixed to the sound conduit tube 62. Illustrated in (c) of FIG. 11 as one example of such an opening shape of the vent hole 67 is the vent hole 67 having a structure of a circular are shaped long hole arranged at one location. It should be noted that, having the vent hole 67 formed at at least one location is sufficient, and the shape and the number of the vent hole can be configured freely.

In the following, descriptions will be provided regarding the structure of the earphone 60, and the action and effect obtained when the earphone 60 according to the sixth embodiment formed as described above is mounted in an external auditory canal.

Similar to the fifth embodiment, sound waves generated from the loudspeaker unit 51 are separated into sound waves propagating to the eardrum and sound waves leaking to outside space. A major difference of the earphone 60 according to the sixth embodiment from the earphone 50 according to the fifth embodiment is an ability to easily and simultaneously adjust the opening sizes of the vent hole 45 and the vent hole 67 by rotating the ear tip 63 in a direction of the arrow shown in (a) of FIG. 11. Specifically, by rotationally sliding the ear tip 63 fit on the sound conduit tube 62 and adjusting the overlap of the sectorial part 28*y* (cf. (c) of FIG. 4) and a second opening 45*b* of the vent hole 45, it is possible to achieve any open state ranging from fully open to sealed. In addition, by rotationally sliding the ear tip 63 fit on the sound conduit tube 62 and adjusting the overlap of the vent hole 67 and the second sound hole 520 (the second vent hole 55), it is possible to increase the minimum resonant frequency of the earphone 60 and avoid an excessive characteristic in the low-pitched sound range. With this, the earphone-wearer can adjust the open state in accordance with the surrounding environment and his/her preference.

Figure 12:
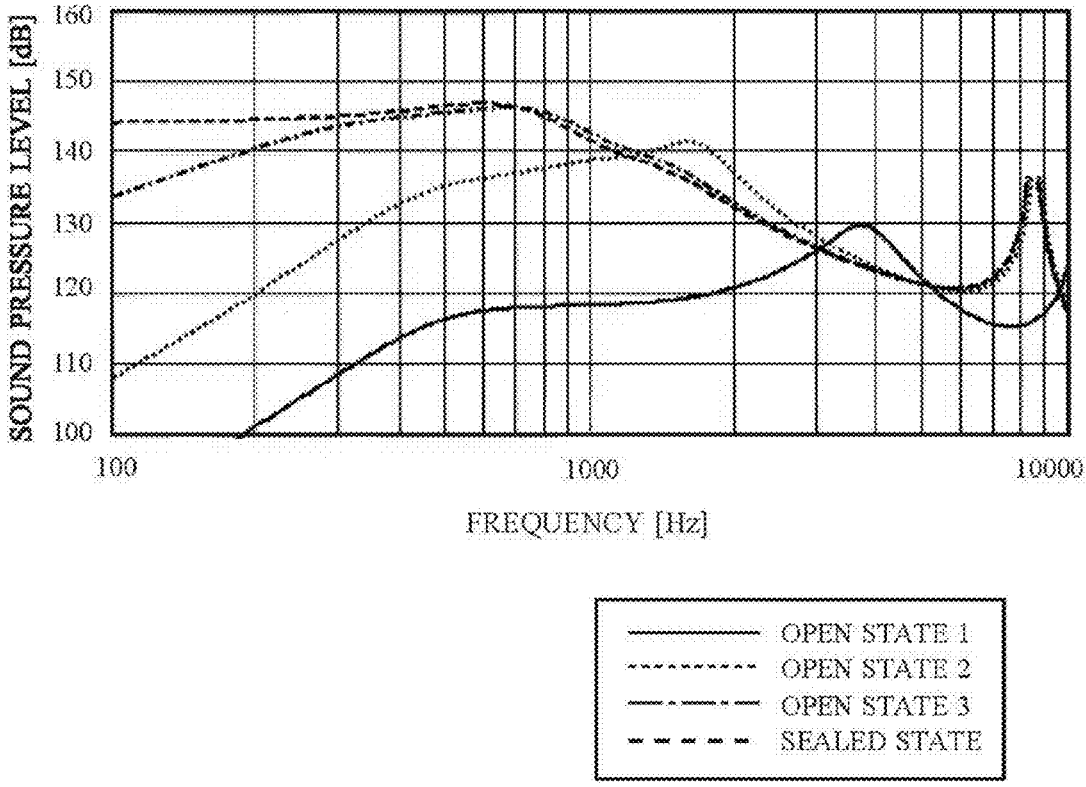
FIG. 12 is for describing the sound-pressure/frequency characteristic of the earphone 60 under different conditions.

FIG. 12 shows the sound-pressure frequency characteristic of the earphone 60 according to the present embodiment when the second vent hole 55 is constantly connected to outside space and when the open state of the first vent hole 45 is changed. In FIG. 12, the horizontal axis represents frequency and the vertical axis represents sound pressure level; and, when open state 1, open state 2, open state 3 indicate the opening sizes of the first vent hole 45 in a descending order, the sound-pressure/frequency characteristics of the respective states are shown with a solid line, a dotted line, and a dot-dash-line. Furthermore, the sound-pressure/frequency characteristic in the sealed state is shown with a broken line. As seen in FIG. 12, although reducing the opening size of the second vent hole 55 improves the low-pitched sound range characteristic, in terms of the balance of the characteristic, a smaller opening size leads to an excessive characteristic in low-pitched sound range.

Figure 13:
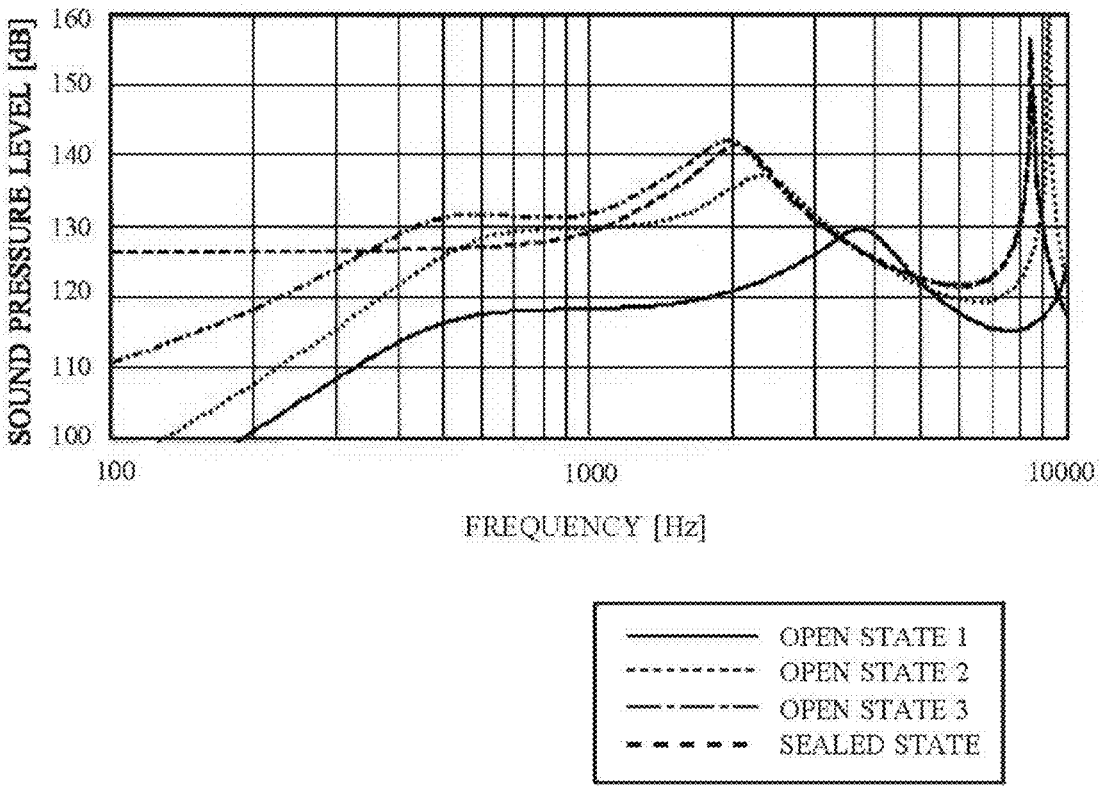
FIG. 13 is for describing the sound-pressure/frequency characteristic of the earphone 60.

FIG. 13 shows the sound-pressure/frequency characteristic of the earphone 60 according to the sixth embodiment. In FIG. 13, the horizontal axis represents frequency and the vertical axis represents sound pressure level; and, when the open state 1, open state 2, and open state 3 indicate the opening sizes of the first vent hole 45 and the second vent hole 55 in a descending order, the sound-pressure/frequency characteristics in the respective states are shown with a solid line, a dotted line, and a dot-dash-line. Furthermore, the sound-pressure/frequency characteristic in the sealed state is shown with a broken line. As seen in FIG. 13, since reduction of the opening size of the first vent hole 45 and reduction of the opening size of the second vent hole 55 are linked in the earphone 60, an excessive characteristic in the low-pitched sound range is not observed in each of the states, and thereby a characteristic of not having excessive sound pressure level for the low-pitched sound range is achieved. Therefore, the user of the earphone 60 can freely select a preferred degree of ventilation by rotating the ear tip 63.

It should be noted that, in the present embodiment, although an example of simultaneously adjusting the opening sizes of the first vent hole 45 and the second vent hole 55 through rotation of the ear tip 63 has been shown; a mechanism for individually adjusting each of those may be used. In addition, the opening shape of the penetration hole 28 of the ear tip 63 may also take any shape (circular shape, elliptical shape, circular arc shape, rectangular shape, etc.), as long as the shape allows changing of the opening sizes of the first vent hole 45 and the second vent hole 55 through rotation of the ear tip 63.

[Seventh Embodiment]

Figure 14:
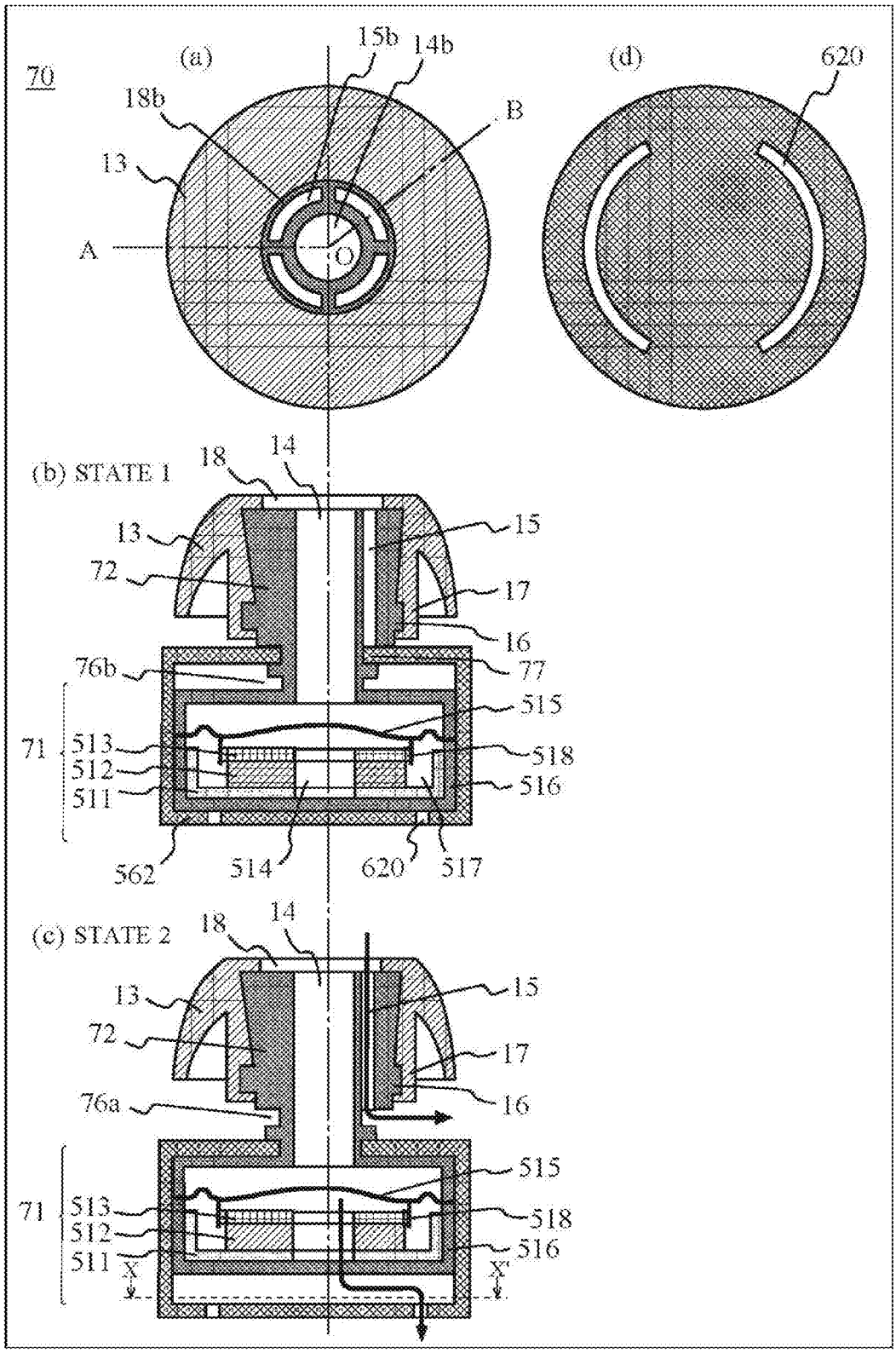
FIG. 14 is a structural drawing of an earphone 70 according to a seventh embodiment.

FIG. 14 shows a structure of an earphone 70 according to a seventh embodiment of the present disclosure. In FIG. 14, (a) is a plan view of the earphone 70, (b) and (c) are cross sectional views along line A-O-B in the earphone 70 shown in (a), and (d) is a cross sectional view along line X-X' in the earphone 70 shown in (c). The earphone 70 according to the seventh embodiment includes a loudspeaker unit 71, a sound conduit tube 72, and the ear tip 13.

The earphone 70 according to the seventh embodiment is also formed with the ability to be used both as a sealed type and an open type; however, the structures of the loudspeaker unit 71 and the sound conduit tube 72 are different from the above described earphones. In the following, descriptions of the earphone 70 will be provided centered on this different configuration.

It should be noted that, configurations of the earphone 70 according to the seventh embodiment identical to those of the earphones 10, 20, 30, 40, 50, and 60 according to the first to sixth embodiments are given the same reference characters, and descriptions thereof are omitted.

The loudspeaker unit 71 includes: the yoke 511; the magnet 512; the plate 513; the diaphragm 515 having the supports 515*a*, 515*b*, 515*c*, and 515*d*; first cover 516; a second cover 526; the voice coil 518; and the magnetic fluid 519.

The first sound hole 514 is formed through the centers of the yoke 511, the magnet 512, and the plate 513. The diaphragm 515 is supported in a vibratable manner by the four supports 515*a*, 515*b*, 515*c*, and 515*d* whose cross-sections have, for example, a roll shape (cf. (d) of FIG. 7). The voice coil 518 is connected, at one end thereof, to the diaphragm 515, and is held within the magnetic gap 517 formed by the yoke 511 and the plate 513. The space between the voice coil 518 and the plate 513 may be or may not be filled with the magnetic fluid 519. It should be noted that, when the space is not filled with the magnetic fluid, sound having an opposite phase will flow into the sound hole 14 if left as is; therefore, it is necessary to prevent the opposite phase sound from flowing into the sound hole 14 by enclosing the whole circumference of the diaphragm 515 using the supports. The first cover 516 is connected to the sound conduit tube 72; and the yoke 511, the magnet 512, the plate 513, the diaphragm 515, and the voice coil 518 are sealed in the space formed by the connection.

The sound conduit tube 72 is a substantially tubular component having the sound hole 14 and the vent holes 15. The sound hole 14 and the vent holes 15 are identical to the sound holes of the earphone 10. In addition, a feature of the sound conduit tube 72 is having, on the outer side surface thereof, a first recessed part 76*a* including the first openings 15*a* of the vent holes 15, and a second recessed part 76*b* with the same shape as the first recessed part 76*a*. It should be noted that, the first recessed part 76*a* and/or the second recessed part 76*b* may be formed to circle around the outer side surface of the sound conduit tube 72 so as to form a groove, or may be formed as a plurality of depressions.

The second cover 526 of the loudspeaker unit 71 has a projected part 77 that is to be fitted in the first recessed part 76*a* and/or the second recessed part 76*b* of the sound conduit tube 72, and has a shape that covers the first cover 516 to form a predetermined space 521. Vent holes 527 are formed at locations where the second cover 526 and the space 521 meet. The vent holes 527 illustrated in (d) of FIG. 14 are structures obtained by arranging circular arc shaped long holes at two locations. It should be noted that, the second cover 526 may be integrally formed with the ear tip 13.

In the following, descriptions will be provided regarding the structure of the earphone 70 according to the seventh embodiment formed as described above. The earphone 70 can take the following two states.

The first of the two states is "state 1" ((b) of FIG. 14) in which the projected part 77 of the second cover 526 is fitted to the first recessed part 76*a* of the sound conduit tube 72. In this state 1, the vent holes 15 of the sound conduit tube 72 and the vent holes 527 of the loudspeaker unit 71 are blocked by the second cover 526 and the first cover 516, respectively, resulting in a sealed state in which leaking of sound waves is blocked.

The second of the two states is "state 2" ((c) of FIG. 14) in which the projected part 77 of the second cover 526 fits the second recessed part 76*b* of the sound conduit tube 72. In this state 2, the vent holes 15 of the sound conduit tube 72 and the vent holes 527 of the loudspeaker unit 71 are both not blocked by the first cover 516 and the second cover 526, resulting in an open state in which sound waves can leak out freely.

With such a structure allowing switching between state 1 and state 2, a user can freely select the proper usage state in accordance with the surrounding environment and his/her preference, in cases such as, for example, when noise in the surrounding environment is large, when suppression of sound leakage from the earphone is desired, and when an inflow of external sounds is desired.

In state 1, the space 521 is eliminated by the second cover 526, and the lower space of the diaphragm 515 becomes a sealed state. With this, it becomes possible to increase the minimum resonant frequency of the earphone, and achieve a characteristic that is well-balanced between low-pitched sound range frequencies and high-pitched sound range frequencies even in the sealed state, and does not have excessive sound pressure level for the low-pitched sound range. On the other hand, in state 2, since the space 521 is formed between the first cover 516 and the second cover 526, stiffness will not increase in the lower space of the diaphragm 515, and there will be no associated increase of the minimum resonant frequency of the earphone 70. With this, deterioration of the low-pitched sound range characteristic can be suppressed even in the open state in which sound leakage from the vent holes 527 occurs. Therefore, the low-pitched sound range characteristic can be maintained at a level equivalent to that of the high-pitched sound range characteristic.

As described above, in the earphones 10, 20, 30, 40, 50, 60, and 70 according to the first to seventh embodiments; included at one portion of a sound conduit tube is a vent hole that is formed independently of a sound hole, and that has one opening thereof formed at a space identical to the space (external auditory canal) where sound waves are released from the sound hole. With this, since a constant vent hole shape can be maintained regardless of the worn state or the shape of an external auditory canal of an earphone wearer, it is possible to constantly achieve uniform acoustic characteristics. Furthermore, according to the earphones of the embodiments, since the vent hole and the sound hole are completely independent and the vent hole is not connected to the sound hole part way through the sound hole, the sound waves generated by the loudspeaker unit can be released into the external auditory canal without being influenced by the vent hole. In addition, according to the earphones of the embodiments, no matter whether the state is either one of the open state and the sealed state, it is possible to achieve, in both states, a characteristic of not having excessive sound pressure level for the low-pitched sound range with respect to that for the high-pitched sound range.

[Application Example]

In the above described first to seventh embodiments, examples have been shown in which the characteristic structure is applied to an earphone (for televisions, portable music players, mobile phones, etc.). However, the characteristic structure of the present disclosure is also applicable to a hearing aid whose receiver is inserted in an external auditory canal.

Figure 15:
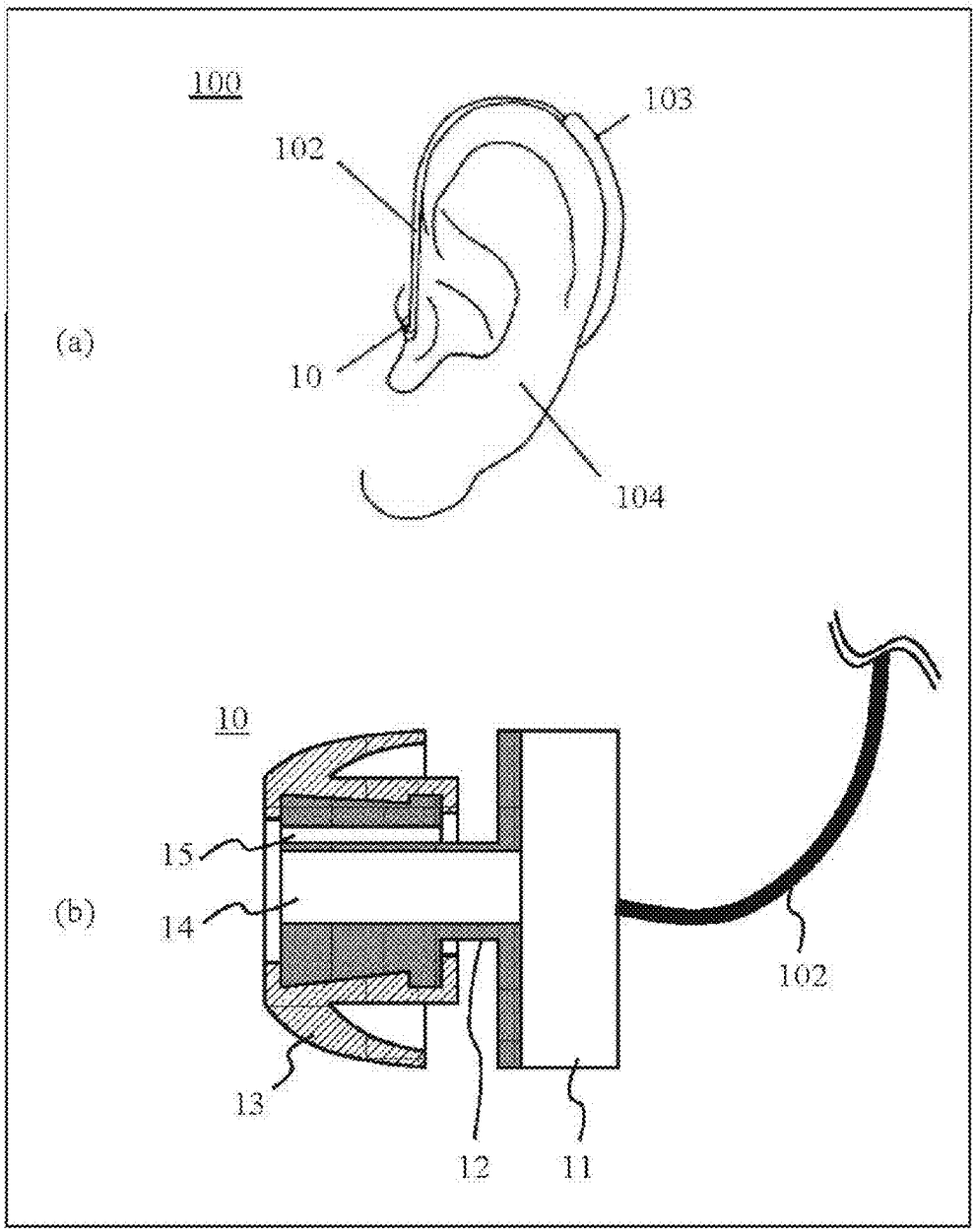
FIG. 15 is a structural drawing regarding a case where the earphone 10 is applied to a hearing aid 100.

FIG. 15 shows one example of a hearing aid 100 having mounted thereon the earphone 10 according to the first embodiment as a receiver. In FIG. 15, (a) shows a state where the hearing aid 100 having the earphone 10 mounted thereon is worn on an ear pinna 104, and (b) is an enlarged view of the earphone 10 which is the receiver part of the hearing aid 100.

The hearing aid 100 includes the earphone 10 (receiver part), a lead tube 102, and a hearing aid main body 103. The hearing aid main body 103 converts sound input in a built-in microphone into acoustic signals, and transmits the acoustic signals to the earphone 10 via the lead tube 102. The earphone 10 converts the acoustic signals transmitted from the hearing aid main body 103 into output sound waves, and releases the output sound waves to the external auditory canal.

When the earphones 40, 50, 60, and 70 according to the fourth to seventh embodiments capable of switching between the sealed state and the open state are used, selecting the open state enables suppression of reverberation of self-generated sounds and stuffiness resulting from long-term use.

It should be noted that elements and the connection modes of those elements etc., shown in each of the embodiments are merely examples, and the present invention is not limited thereto. Essential configurations of the present invention are limited by an independent claim showing the most generic concept. Therefore, elements that are described in the embodiments but are not disclosed in an independent claim are not essential, and they have been set forth as examples of the embodiments.

Industrial Applicability

An earphone of the present disclosure is applicable as an earphone for televisions, portable music players, mobile phones, etc., and is particularly useful when there is a desire to avoid any changes to the sound-pressure/frequency characteristic of the earphone.

Description of the Reference Characters

10, 20, 30, 40, 50, 60, 70, 200 earphone
11, 31, 51. 71, 201 loudspeaker unit
12, 22, 32, 42, 52, 62, 72, 202 sound conduit tube
13, 23, 43, 53, 63, 203 ear tip
14, 34, 204, 514, 520 sound hole
15, 25, 35, 45, 55, 65, 67, 205, 527 vent hole
14*a*, 14*b*, 15*a*, 15*b*, 25*a*, 25*b*, 28*b*, 34*a*, 34*b*, 35*a*, 35*b*, 45*a*, 45*b* opening
16, 47, 77 projected part
17, 46*a*, 46*b*, 76*a*, 76*b* recessed part
18, 28. 31*a* penetration hole
57 lid part
102 lead tube
103 hearing aid main body
104 ear pinna
511 yoke
512 magnet
513 plate
515 diaphragm
515*a*, 515*b*, 515*c*, 515*d* support
516, 526 cover
517 magnetic gap
518 voice coil
519 magnetic fluid
521 space

The invention claimed is:

1. An earphone comprising:

a loudspeaker unit configured to generate sound waves;

a sound conduit tube connected to the loudspeaker unit; and an ear tip connected to the sound conduit tube, and having a shape that has at least one opening, wherein the sound conduit tube has a shape that has:

a sound hole having a first opening through which the sound waves generated by the loudspeaker unit enter, and a second opening from which the sound waves are released and to which the ear tip is connected; and a vent hole formed independently of the sound hole, and having a third opening through which a portion of the sound waves released from the second opening enters and a fourth opening from which the portion of the sound waves is released outside the earphone, and the second opening of the sound hole and the third opening of the vent hole are connected to an identical opening of the ear tip, wherein an opening size of the fourth opening of the vent hole is adjusted by parallelly moving the ear tip along the sound conduit tube.

2. The earphone according to claim 1, wherein the loudspeaker unit has a shape that has:

a first sound hole from which sound waves are released to the sound conduit tube; and a second sound hole from which sound waves having an opposite phase of the sound waves released from the first sound hole are released, and opening sizes of the fourth opening and the second sound hole are simultaneously adjusted by parallelly moving the ear tip along the sound conduit tube.

3. The earphone according to claim 2, wherein adjustment is made such that the fourth opening and the second sound hole are both blocked.

4. The earphone according to claim 1, wherein the loudspeaker unit has a shape that has:

a first sound hole from which sound waves are released to the sound conduit tube; and a second sound hole from which sound waves having an opposite phase of the sound waves released from the first sound hole are released, the loudspeaker unit includes a cover having formed thereon holes corresponding to the first sound hole and the second sound hole, and opening sizes of the fourth opening and the second sound hole are simultaneously adjusted by parallelly moving the cover along the loudspeaker unit.

5. The earphone according to claim 4, wherein adjustment is made such that the fourth opening and the second sound hole are both blocked.

6. The earphone according to claim 1, wherein a magnetic fluid is used in the loudspeaker unit.

7. A hearing aid comprising the earphone according to claim 1.

8. A headset comprising the earphone according to claim 1.

9. The earphone according to claim 1, wherein the fourth opening of the vent hole is formed at a location that is not blocked simultaneously with the third opening.

10. The earphone according to claim 1, wherein the sound hole is formed at a center of the sound conduit tube, and the vent hole is formed independently of the sound hole at an outer circumference thereof.

11. The earphone according to claim 1, wherein the vent hole is formed at a center of the sound conduit tube, and the sound hole is formed independently of the vent hole at an outer circumference thereof.

12. An earphone comprising:

a loudspeaker unit configured to generate sound waves;

a sound conduit tube connected to the loudspeaker unit; and an ear tip connected to the sound conduit tube, and having a shape that has at least one opening, wherein the sound conduit tube has a shape that has:

a sound hole having a first opening through which the sound waves generated by the loudspeaker unit enter, and a second opening from which the sound waves are released and to which the ear tip is connected; and a vent hole formed independently of the sound hole, and having a third opening through which a portion of the sound waves released from the second opening enters and a fourth opening from which the portion of the sound waves is released outside the earphone, and the second opening of the sound hole and the third opening of the vent hole are connected to an identical opening of the ear tip, wherein an opening size of the third opening of the vent hole is adjusted by rotationally moving the ear tip around the sound conduit tube.

13. The earphone according to claim 12, wherein the loudspeaker unit has a shape that has:

a first sound hole from which sound waves are released to the sound conduit tube; and a second sound hole from which sound waves having an opposite phase of the sound waves released from the first sound hole are released, and opening sizes of the third opening and the second sound hole are simultaneously adjusted by rotationally moving the ear tip around the sound conduit tube.

14. The earphone according to claim 13, wherein adjustment is made such that the third opening and the second sound hole are both blocked.

15. The earphone according to claim 12, wherein a magnetic fluid is used in the loudspeaker unit.

16. A hearing aid comprising the earphone according to claim 12.

17. A headset comprising the earphone according to claim 12.

18. The earphone according to claim 12, wherein the fourth opening of the vent hole is formed at a location that is not blocked simultaneously with the third opening.

19. The earphone according to claim 12, wherein the sound hole is formed at a center of the sound conduit tube, and the vent hole is formed independently of the sound hole at an outer circumference thereof.

20. The earphone according to claim 12, wherein the vent hole is formed at a center of the sound conduit tube, and the sound hole is formed independently of the vent hole at an outer circumference thereof.

* * * * *